US006393959B1

(12) United States Patent
Amemiya

(10) Patent No.: US 6,393,959 B1
(45) Date of Patent: May 28, 2002

(54) MINE DISPOSAL APPARATUS AND MINE DISPOSAL METHOD

(75) Inventor: Kiyoshi Amemiya, Yamanashi (JP)

(73) Assignee: Yamanashi Hitachi Construction Machinery Co., Ltd., Yamanashi (JP)

( * ) Notice: Subject to any disclaimer, the term of this patent is extended or adjusted under 35 U.S.C. 154(b) by 0 days.

(21) Appl. No.: 09/380,132

(22) PCT Filed: Dec. 21, 1998

(86) PCT No.: PCT/JP98/05769

§ 371 (c)(1),
(2), (4) Date: Dec. 1, 1999

(87) PCT Pub. No.: WO99/34164

PCT Pub. Date: Jul. 8, 1999

(30) Foreign Application Priority Data

Dec. 25, 1997 (JP) ..... 9-356829
Oct. 27, 1998 (JP) ..... 10-305099

(51) Int. Cl.[7] ..... B64D 1/04
(52) U.S. Cl. ..... 89/1.13; 172/122
(58) Field of Search ..... 89/1.13; 172/122, 172/123

(56) References Cited

U.S. PATENT DOCUMENTS 5,442,990 A * 8/1995 Krohn ..... 89/1.13
5,844,160 A * 12/1998 Cieszkiewicz ..... 89/1.13
5,988,037 A * 11/1999 Haughom et al. ..... 89/1.13

FOREIGN PATENT DOCUMENTS

| | | | |
|---|---|---|---|
| JP | H2-190503 | A | 7/1990 |
| JP | H7-71898 | A | 3/1995 |
| JP | H8-320199 | A | 12/1996 |
| JP | H9-105125 | A | 4/1997 |
| JP | H9-311000 | A | 12/1997 |
| JP | H10-253298 | A | 9/1998 |

* cited by examiner

*Primary Examiner*—J. Woodrow Eldred
(74) *Attorney, Agent, or Firm*—Koda & Androlia

(57) ABSTRACT

A mine disposal apparatus is capable of carrying out works including preparation works such as a vegetation work, a collapsed sediment removing work, etc., and safely and surely disposing personnel mines separated from the tank mines, unexploded shells, etc., and further effectively improving the disposed lands to farmlands. The mine disposal apparatus comprises a heavy vehicle (1) used for shovel type machines such as back hoes, a rotary cutter (9) is attached in place of a bucket of the shovel machine to a distal end of a derrickable and foldable arm (2) of the heavy vehicle (1), the rotary cutter (9) comprising a rotational drum (10) having cutter bits (11) embedded in a circumferential face of the rotational drum and being capable of cutting earth up to a depth of 30 cm or more.

10 Claims, 44 Drawing Sheets

MINE DISPOSAL APPARATUS AND MINE DISPOSAL METHOD

TECHNICAL FIELD

This invention relates to a mine disposal apparatus and method which are capable of effectively disposing personnel mines, and also reforming lands to ensure farmlands after the mine disposal.

BACKGROUND ART

All the personnel mines are conventionally disposed by manual works. In detail, the manual work is generally carried out by detecting the mines one by one by the use of a mine detector, similar to a metal detector, fixed to a long bar body, confirming, the condition of the mine while sprinkling water, if detecting the mine, to soften the earth therearound, removing the earth by using a brush to expose the mine, and then exploding the mine by explosives.

In this way, the mines are conventionally disposed one by one depending on the experience and the six sense of the specialists. There are many cases that personnel mines, which are of a compact plastic type, are carried away during the rainy season and then embedded under the neglected paddy fields as floating mines, thereby making it difficult to detect them.

Therefore, there is proposed a caterpillar vehicle, especially, a caterpillar vehicle disclosed in Japanese Provisional Patent Publication (Kokai) No. 7-71898, in which using a bulldozer in order to sweep mines enables the mines to be effectively swept without exposing the bulldozer to danger occurring in'sweeping the mines.

The caterpillar vehicle is provided with a front construction body operatively coupled to the caterpillar vehicle so as to move up and down through a hydraulic or pneumatic cylinder piston unit, and also, if circumstances require, through an underframe rotatably fixed to the caterpillar vehicle. The front construction body has a box at least partially opening at a front side and a back side thereof with respect to the travelling direction, and the box has therein a milling drum, of especially hydraulically rotated type, which is disposed also on a lateral side thereof essentially with respect to the travelling direction.

There is disclosed that the above caterpillar vehicle rotates, as a mine vehicle, the milling drum in the opposite direction to the travelling direction of the vehicle to feed the mine in front of the milling drum, to thereby explode the mine there under pressure.

There is proposed another mine disposer in Japanese Provisional Patent Publication (Kokai) No. 8-320199, in which a device comprising a horizontal rotational shaft and a number of flail type hammer bodies of super alloy arranged on the rotational shaft is disposed on a distal end of a derrickable and foldable arm of a heavy vehicle used for shovel machines.

According to the mine disposer proposed in Japanese Provisional Patent Publication (Kokai) No. 8-320199, a number of the flail type hammer bodies of super alloy are arranged on the rotating shaft at the distal end of the derrickable and foldable arm of the heavy vehicle used for shovel machines; therefore, getting the hammers close to the ground and then rotating the rotational shaft causes the hammers to strike the ground, thereby causing the hammers to crush, even if the mine is embedded in the ground, the mine through its outer casing such as a case to break it into fragments without large explosion However, the caterpillar vehicle disclosed in Japanese Provisional Patent Publication (Kokai) No. 7-71898 has some problems. That is, the caterpiller vehicle is comprised of a bulldozer which is so constructed to sweep the mines; therefore, it is firstly limited in movement to the bulldozer to disable the position of the milling drum for exploding the mines to be changed without advancing and turning the vehicle itself, which deteriorates the small sharp turn and the speediness.

Also, the milling drum for exploding the mines get close to the vehicle main body, causing the driver's seat to get close to the explosion location, which causes the driver to be exposed to danger, and also may cause the caterpillars of the vehicle to be damaged in the case of a tank mine having a large explosion force.

Therefore, the caterpillar vehicle disclosed in Japanese Provisional Patent Publication (Kokai) No. 7-71898 rotates the milling drum in the opposite direction to the travelling direction of the vehicle to feed the mine in front of the milling drum to thereby explode the mine there under the pressure, thereby preventing the mines from getting close to the vehicle. This, however, causes the cut sediment to reversely cover the mine to embed the mine deeply, which may makes impossible it to surely explode the mine. In particular, the personnel mines are designed to be laid relatively shallowly in the ground to explode by a small shock, as is distinct from tank mines. Therefore, it is not preferable to explode the personnel mines while applying the pressure to the milling drum like the caterpillar vehicle disclosed in Japanese Provisional Patent Publication (Kokai) No. 7-71898.

Also, there is disclosed that the milling drum has cutting tools and/or crushing tools especially at regular intervals on its circumferential surface; therefore, these tools catch the mines from below and then the pressure applied by the milling drum itself explodes the mines mixed in the sediment transferred in front of the milling drum. But there is not identified in detail the construction of the cutting tools and/or the crushing tools.

On the other hand, the mine disposer shown in Japanese Provisional Patent Publication (Kbkai) No. 8-320199 has the mine disposing mechanism at the distal end of the derrickable and foldable arm of the heavy vehicle used for shovel machines such as back hoes; therefore, it is possible to carry out a forwarding (advancing) and turning compound movement by moving an arm, and carrying out mine disposal over a wide range by turning the arm while carrying out works, and also carrying out a wide range-working by extending the arm to a steep slope or a narrow place where the machines cannot enter.

However, a number of the flail type hammer bodies of super alloy are arranged on the rotating shaft; therefore, getting the hammers close to the ground surface and then rotating the rotational shaft causes the hammers to strike the ground surface, thereby causing the hammers to crush, even if the mine is embedded in the ground, the mine through its outer casing such as a case to break it into fragments without large explosion. However, such hammer bodies are poor in sediment-cutting ability, which disables, if the mines are embedded relatively deeply in the ground, the hammers to exhibit its performance.

In particular, there are many cases that personnel mines, which are of a compact plastic type, are carried away during the rainy season and then embedded under the neglected paddy fields as floating mines, which makes it difficult to detect the mines. Further, if the neglected time period becomes long, the mines may be undesirably covered with vegetation such as shrub, ditch reed, and grass and embedded with collapsed sediment such as clayey wall, mound, and bank, which requires such a preparation work as to prepare a working environment before the mine disposing work. However, the extra attention has been not given to such a preparation up to now.

Also, the embedded things include not only personnel mines but also tank mines or unexploded shells. Handling them all as the personnel mines may bring serious accidents. In the case of the tank mine, etc., having a large explosion force, the vehicle, etc., may be damaged.

Improving the mine disposal area to farmlands requires other agricultural implements, which makes the operation troublesome.

It is therefore an object of the present invention to solve the above-mentioned conventional disadvantages, and hence to provide a mine disposal apparatus and method which are capable of firstly systematically carry out works including preparation works such as a vegetation work, a collapsed sediment removing work, etc, and secondly safely and surely disposing personnel mines separately from the tank mines, the unexploded shells, etc., and further effectively carrying out works of improving the disposed lands to farmlands.

In more detail, it is therefore objects of the present invention to provide a mine disposal apparatus which is capable of carrying out a forwarding (advancing) and turning compound movement by moving an arm, and carrying out mine disposal over a wide range by turning the arm while carrying out works, and also carrying out a wide range-working by extending an arm to a steep slope or a narrow place where machines cannot enter, and which is capable of surely excavating, cutting and crushing the mines embedded in the sediment, and further carrying out various works of, e.g. cutting and crushing grass, bush, mines, shrub, stumps, and tall trees, and realizing a large amount of the works, and which is capable of carrying out works of, e.g. effectively selecting the remains such as the mines and the shrub, or leveling of the ground, and ditching.

Further, it is objects of the present invention to similarly provide a mine disposal apparatus and a mine disposal method which are capable of safely carrying out detection over a wide range, and detecting mines over a wide range by extending an arm to a steep slope or a narrow place where machines cannot enter.

DISCLOSURE OF THE INVENTION

To attain the above-mentioned objects, the gist of a mine disposal apparatus resides firstly in that the apparatus comprises a heavy vehicle used for shovel type machines such as back hoes, a rotary cutter is attached in place of a bucket to a distal end of a derrickable and foldable arm of the heavy vehicle, the rotary cutter comprising a rotational drum having cutter bits embedded in a circumferential face of the rotational drum and being capable of cutting earth up to a depth of 30 cm or more and removing the earth on the opposite side to the advancing direction, secondly in that the rotary cutter has cutter holders welded on the circumferential face of the rotational drum, and the cutter bits are detachably attached to the cutter holders, and thirdly in that the rotary cutter is of a hydraulic motor directly coupled type, and has driving motors on left and right portions of the rotary cutter.

Also, the gist of a mine disposal apparatus resides fourthly in that the rotary cutter is attached to the distal end of the derrickable and foldable arm of the heavy vehicles used for the shovel type machines through an attachment detachably-attaching device having a built-in sliding mechanism at a distal end of a link mechanism for varying a distance between members for holding pins of the attachment, fifthly in that the rotary cutter has a left and right directionwise rotational mechanism below a portion thereof coupled to said attachment detachably-attaching device, sixthly in that a window glass of a driver's seat of the heavy vehicle is comprised of a special bullet-proof glass, and a guard of a metal-made net body is disposed on a front side of the window, seventhly in that the rotary cutter is replaceable with a skeleton bucket by the use of the attachment detachably-attaching device, eighthly in that a sensor portion of a mine counter is attached to the attachment detachably-attaching device, or in that a sensor portion of a mine counter is attached to a side portion of said derrickable and foldable arm of the heavy vehicle used for shovel type machines such as back hoes.

Further, the gist of the mine disposal apparatus resides ninthly in that the rotary cutter is provided with a rateau, and tenthly in that the rotary cutter, the cutter bits are arranged on the rotational drum spirally in such a manner that the spirally winding direction corresponds to the rotational direction.

The gist of a mine disposal method resides firstly in comprising the steps of, by the use of an apparatus in which a rotary cutter with a rateau, or a skeleton bucket as an attachment is replaceably attached to a distal end of a derrickable and foldable arm of a heavy vehicle used for shovel type machines such as back hoes, and a sensor portion is attached to a lateral side portion of an arm, carrying out a preparation work of removing vegetation such as shrub, ditch reed, and grass by the rotary cutter, or removing collapsed sediment such as clayey wall, mound, and bank by said skeleton bucket; distinguishing between a personnel mine, and a tank mine or an exploded shell by said sensor portion; exposing the tank mine or said exploded shell, if extinguished, by the rateau of the rotary cutter or the skeleton bucket, and thereafter transporting the tank mine or the exploded shell to an explosion spot by manual works, etc.; and breaking the personnel mine, if extinguished, by the rotary cutter rotating at a high speed, and secondly in that cutter bits of the rotary cutter are replaced, and then the rotary cutter carries out farming after the mine disposing work.

There have been many cases that the conventional mine disposal is carried out by the manual work in order to realize 100% perfect mine disposal, which has provided problems from the viewpoints of the safety of the workers and the working capacity. Also, many of the working places are bush- and grass-grown grounds, which has required a long time to carry out the disposal.

According to the invention as claimed in claim 1, it is possible to turn while rotating the rotary cutter disposed on the distal end of the arm, and then operate a boom arm, to thereby cut and break bush, grass, etc., on the wastelands, and also to break and dispose the personnel mines embedded in the ground at a stroke. In particular, the rotary cutter rotating at a high speed comprises a rotational drum having the cutter bits at the circumferential face of the rotational drum and is capable of cutting the earth up to a depth of 30 cm or more; therefore, it is possible to excavate, even if they are embedded in the earth, the personnel mines, and then to deform, when the cutter bits bring contact to the mines, the struck personnel mines and then break the internal explosive system, to thereby cut the electric circuit.

Next blades (cutter bits) drag the personnel mine in the rotary cutter to thereby break the explosives, etc., into fragments with the lid separated from the case.

Therefore, the personnel mines with an electric type fuse do not explode. On the other hand, as to the personnel mines with a mechanical type fuse, only the fuses explode, but the personnel mines themselves do not explode. The disposed mines are discharged on the ground on an opposite side to the travelling direction while being separated into the cases, the lids, and the electric circuit boards, which prevents the personnel mines from being covered and embedded with mud.

According to the invention as claimed in claim 1, the rotary cutter has the cutter holders welded on the circumferential face of the rotational drum, and the cutter bits are detachably attached to the cutter holders. Therefore, it is possible to, in addition to the above effect, replace the cutter bits when they are abraded and damaged, and also to selectively use a plurality kinds of cutter bits according to the working site, e.g. a super alloy long nose type one for enhancing the durability, a short nose type one for mainly enhancing the cutting force to the hard earth at the working site, and an angle type cutting blade which is capable of cope with sand and gravel also.

According to the invention as claimed in claim 1, the rotary cutter is of a hydraulic motor directly coupled type, and has the driving motors on left and right portions of the rotary cutter, resulting in a high efficiency and a high performance, which makes it a 5,000 hr no-maintenance type one with a reduced running cost.

According to the invention as claimed in claim 1, the rotary cutter disposed at the distal end of the arm can be replaced with the other attachment, e.g. a skeleton bucket, etc., in a short time.

According to the invention as claimed in claim 2, the rotary cutter is variable in rotation direction by the left and right directionwise rotational mechanism, resulting in a minute positioning, which increases ease-of-use, e.g. a perfect disposal up to the edge of a road, or near the wall of a house.

According to the invention as claimed in claim 3, the special bullet-proof glass and the guard can protect the operator from the personnel mines and the scattering things.

According to the invention as claimed in claim 4, attaching the rotary cutter as an attachment enables trees, shrub, and ditch reed, hindering the detecting work, to be cut, chipped, and weeded. Also attaching the skeleton bucket enables collapsed sediment such as clayey wall, mound, and bank, hindering the detecting work and the disposing work, to be removed up to the initial ground. In this manner, the preliminary preparation work is carried out, followed by detecting the mines by the sensor portion, distinguishing between the personnel mines, and the tank mines or the unexploded shells at that time, and excavating the tank mine or the unexploded shell, if extinguished, by the skeleton bucket, and further breaking the personnel mine, if extinguished, by the rotary cutter rotating at a high speed without explosion, and discharging the fragments on the ground. Furthermore, the rotary cutter carries out a farmland improving work after the mine disposal.

According to the invention as claimed in claim 5, the sensor portion of the mine detector can be, in detecting the mines also, attached to the distal end of the derrickable and foldable arm of the heavy vehicle used for shovel type machines such as back hoes; therefore, it is possible to carry out mine-detection from a safe apart location, and also to carry out a forwarding (advancing) and turning compound movement by moving an arm, and carry out the mine disposal over a wide range by turning the arm while carrying out works, and also carry out a wide range-working by extending an arm to a steep slope or a narrow place where machines cannot enter. Further, it is possible to easily carry out replacement between the mine detection apparatus and the mine disposal apparatus by the use of the attachment detachably-attaching device in the same heavy vehicle.

According to the invention as claimed in claim 6, the sensor portion of the mine detector can, similarly to the invention as claimed in claim 5, be attached to the distal end of the derrickable and foldable arm of the heavy vehicle used for shovel type machines such as back hoes; therefore, it is possible to carry out mine-detection from a safe apart location, and also to carry out a forwarding (advancing) and turning compound movement by moving an arm, and carry out the mine disposal over a wide range by turning the arm while carrying out works, and also carry out a wide range-working by extending an arm to a steep slope or a narrow place where machines cannot enter. Further, it is possible to carry out effective works from mine detection to mine disposal in close association with the rotary cutter carrying out mine disposal.

According to the invention as claimed in claim 7, it is possible to sweep up and remove by the reteau trees, etc., cut by the rotary cutter at the time of the preparation work, and laid flat on the ground, even when they hinder further detecting work. Further, the invention can be applied to a reclamation work of agitating earth into croplands. Furthermore, if the exploded shell is found out, the use of the rateau on a front portion of the rotary cutter causes the exploded shell to be safely picked up and then removed in the rear of the machine main body. Thereafter, it is transported by manual works, and then disposed.

According to the invention as claimed in claim 8, the cutter bits are arranged in a spiral manner. Therefore, it is possible to provide a screw effect in cutting, and prevent bush, etc., from tangling therewith. Reversely rotating the rotary cutter provides an effect of removing earth sideways.

According to the invention as claimed in claim 9, similarly to the above work, it is possible to systematically and effectively carry out disposing and removing of various kinds of vegetation on the ground hindering the works, detecting and confirming and displaying the buried things such as mines, etc., under the ground, and disposing and removing the mines, etc.

According to the invention as claimed in claim 10, in addition to the above effect of the invention as claimed in claim 9, only replacement of the cutter bits enables a farmland improving work after mine disposal to be carried out by using the rotary cutter, which eliminates the need for using other agricultural machines.

BEST MODE FOR CARRYING OUT THE INVENTION

Figure 12:
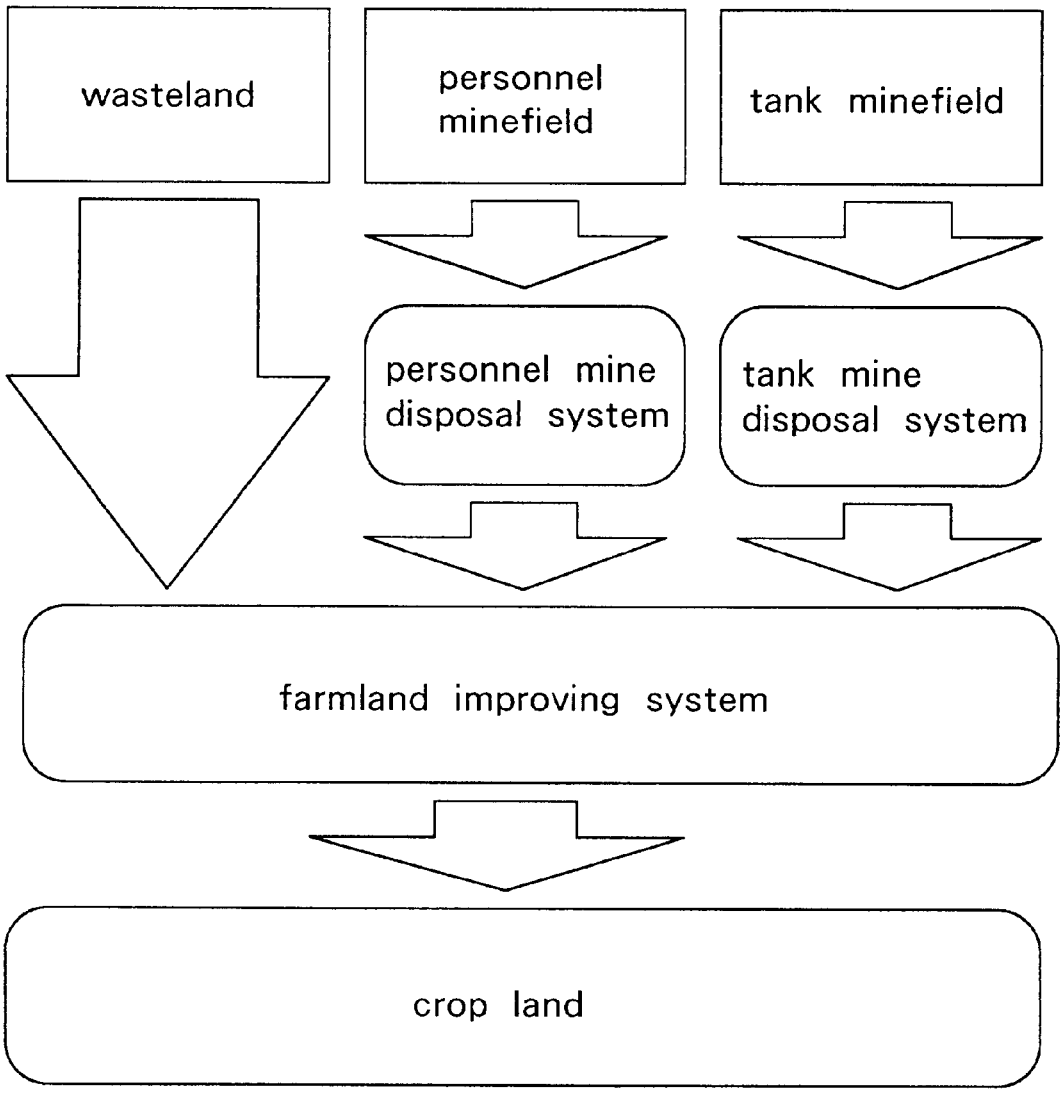
FIG. 12 is a block diagram generally showing a system in the mine disposal apparatus and method according to the present invention.

The inventions will now be described in detail with reference to the drawings showing respective embodiments. The system of a mine disposal apparatus and a mine disposal method, which will be first generally described with reference to FIG. 12, is comprised of a combination of a mine disposal system and a farmland improving system. The mine disposal system is comprised of a personnel mine disposal system and a tank mine (and unexploded shell) disposal system. Objects to be disposed include wastelands, personnel minefields and tank minefields.

Figure 1:
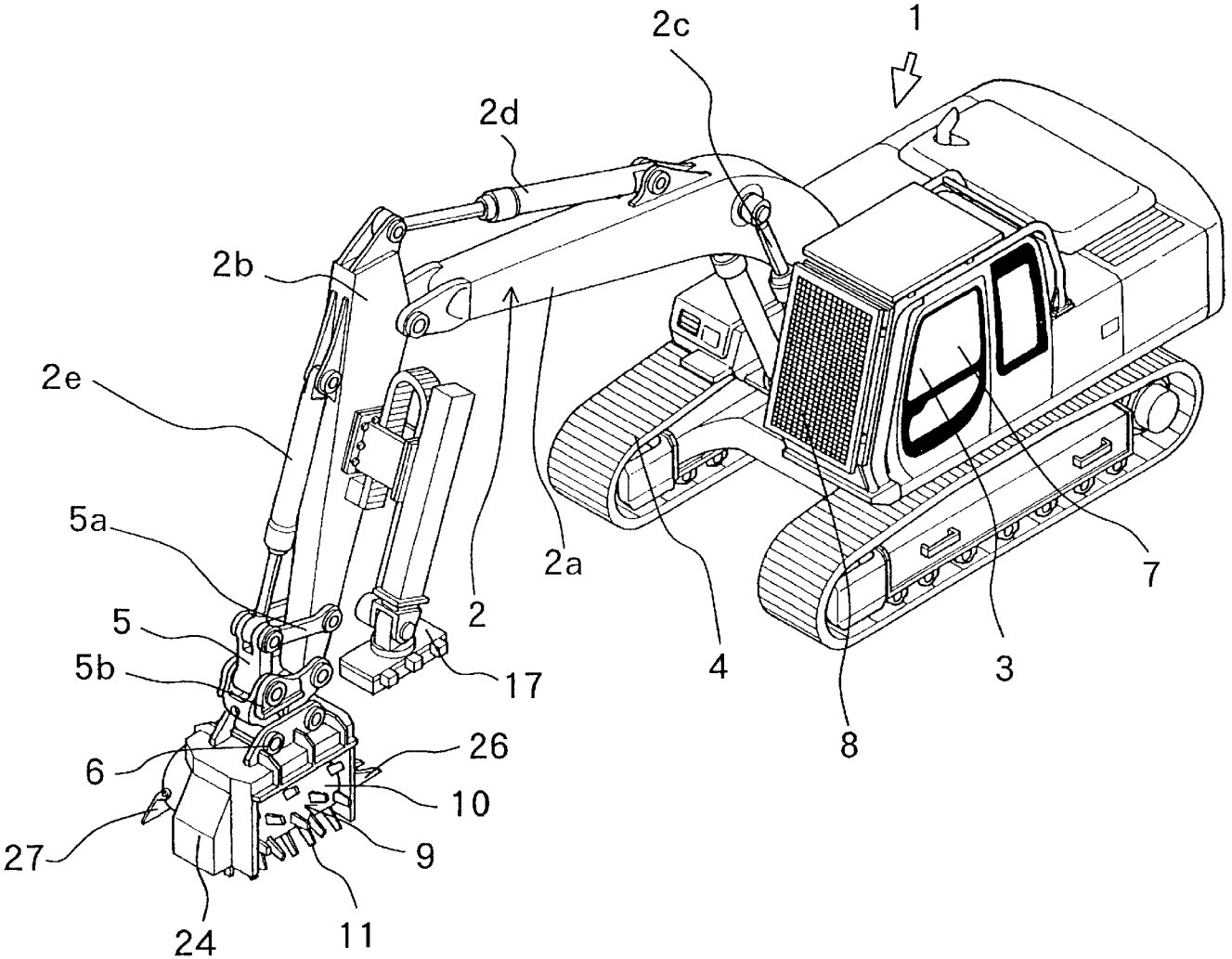
FIG. 1 is a perspective view of a first embodiment of a mine disposal apparatus according to the present invention, in which a rotary cutter is used.
Figure 2:
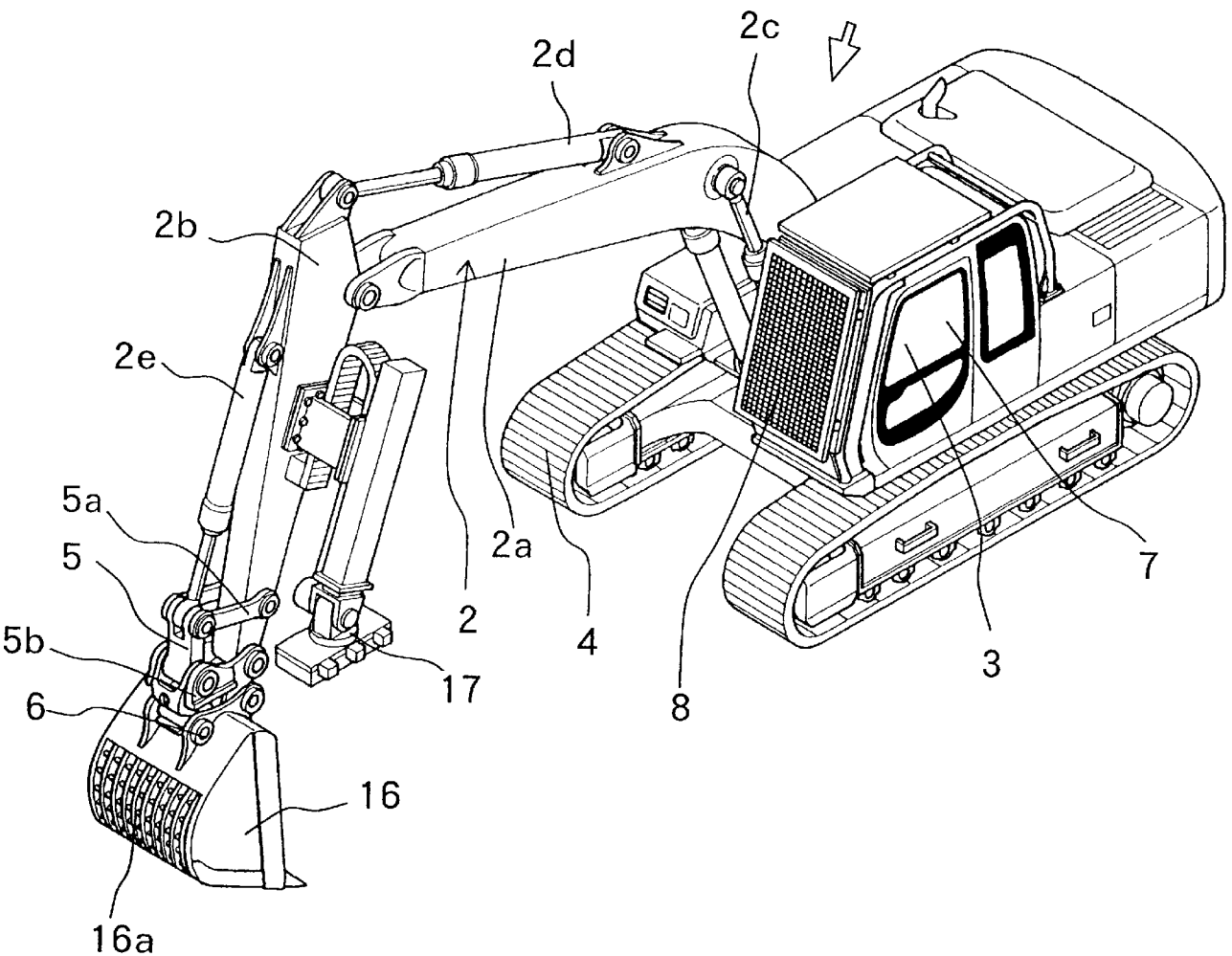
FIG. 2 is a perspective view of a first embodiment of a mine disposal apparatus according to the present invention, in which a skeleton bucket is used.
Figure 3:
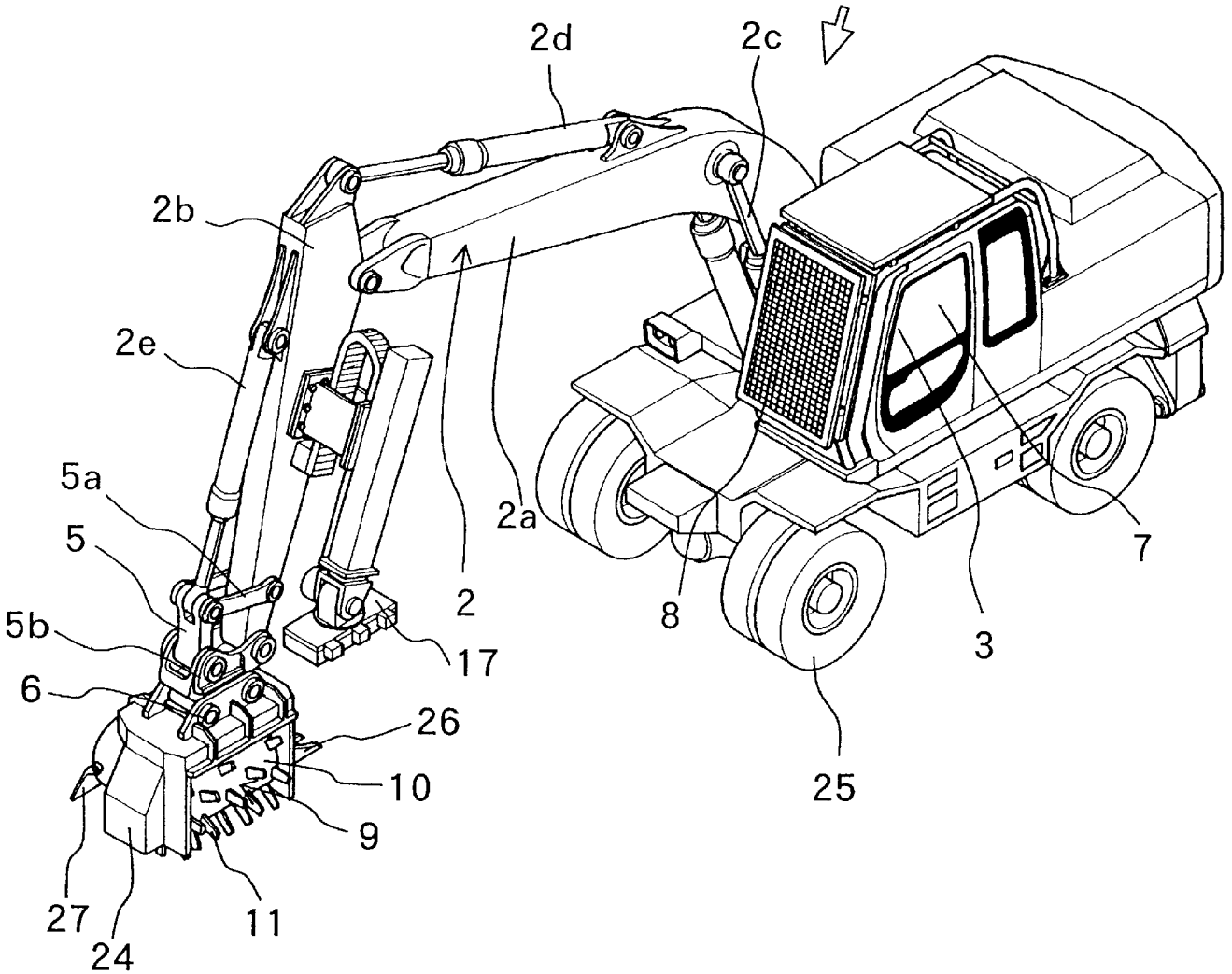
FIG. 3 is a perspective view of a second embodiment of a mine disposal apparatus according to the present invention, in which a rotary cutter is used.
Figure 4:
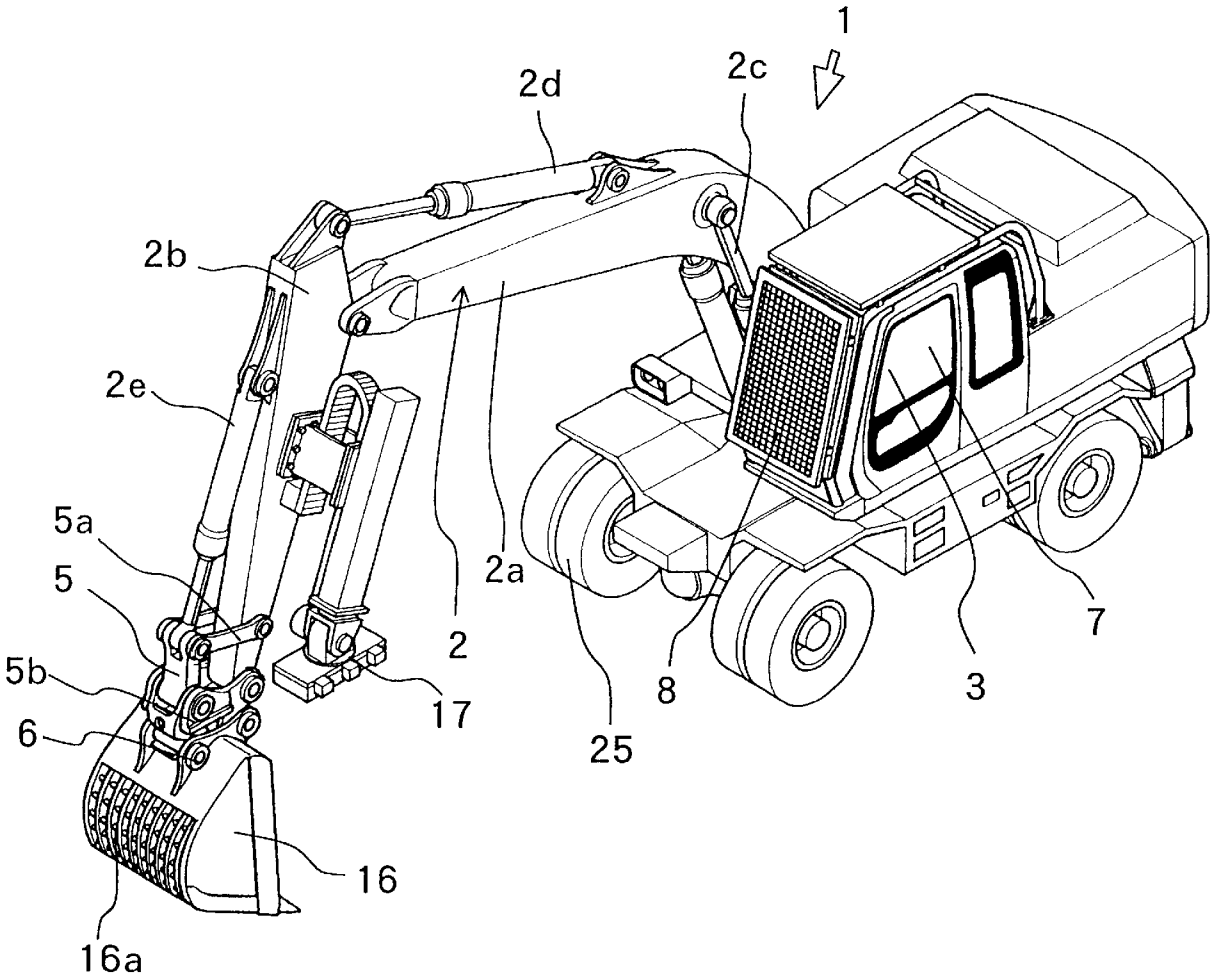
FIG. 4 is a perspective view of a second embodiment of a mine disposal apparatus according to the present invention, in which a skeleton bucket is used.

A mine disposal apparatus according to the present invention, as shown in FIGS. 1 and 2, is comprised of a heavy vehicle (base machine) 1 used for shovel type machines such as back hoes, which vehicle is provided with a derrickable and foldable arm 2. Reference numeral 3 designates a driver's seat (cabih), and 4 a crawler type travelling caterpillar band; alternatively, a wheel type travelling gear having wheels 25, shown in FIGS. 3 and 4, may be employed in place of the caterpillar band. The caterpillar band 4 exhibits its ability at a steep slope, etc., but the wheel type one increases a forward (backward) force at a flat.

Figure 26:
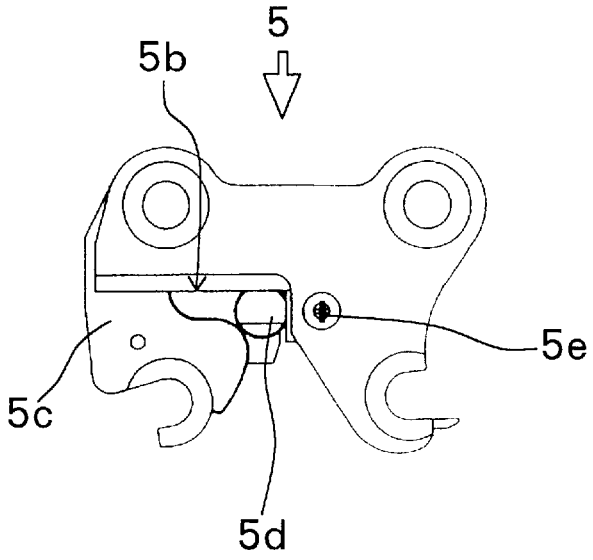
FIG. 26 is a view useful in explaining an attachment detectably-attaching device in an extended state.
Figure 27:
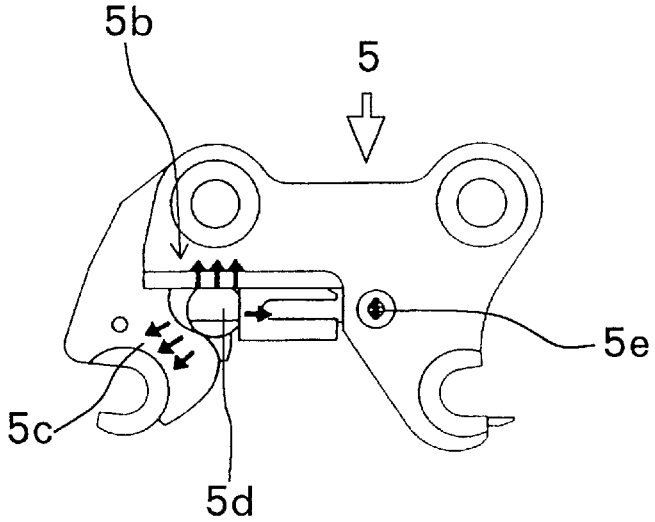
FIG. 27 is a view useful in explaining the attachment detectably-attaching device in an shortened state.
Figure 28:
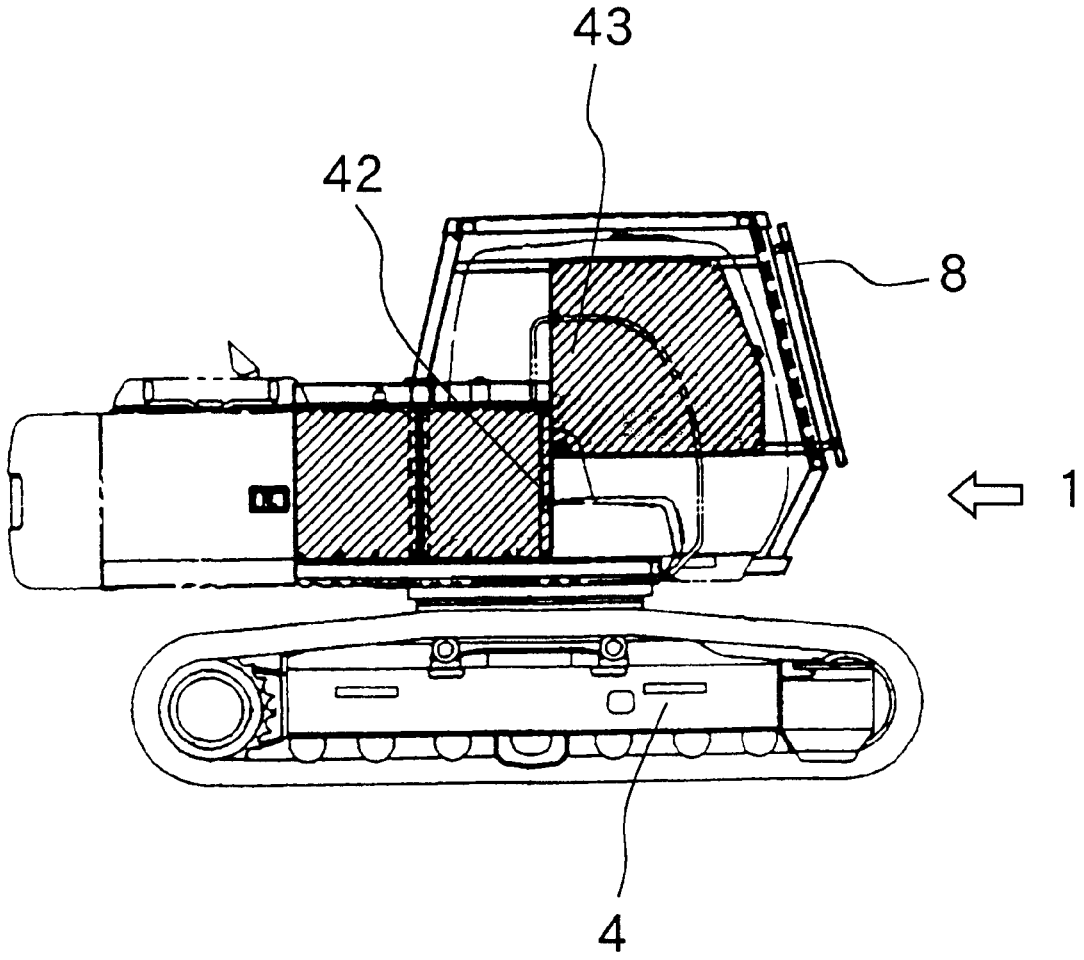
FIG. 28 is a left-hand side view of an example of a reinforced heavy vehicle.
Figure 29:
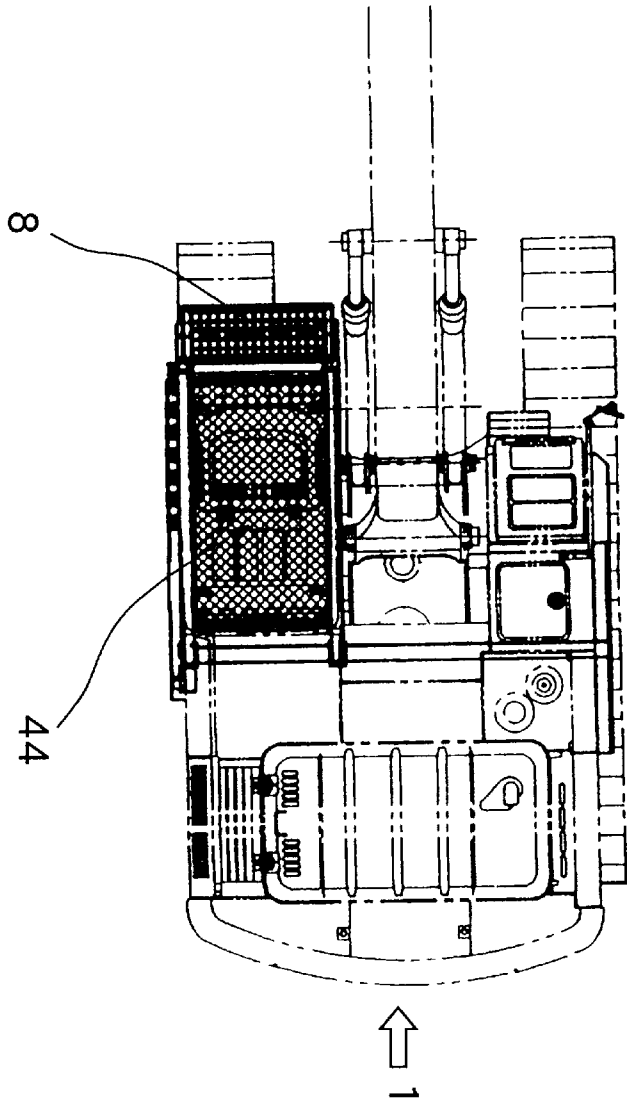
FIG. 29 is a plan view of the example of the reinforced heavy vehicle.
Figure 30:
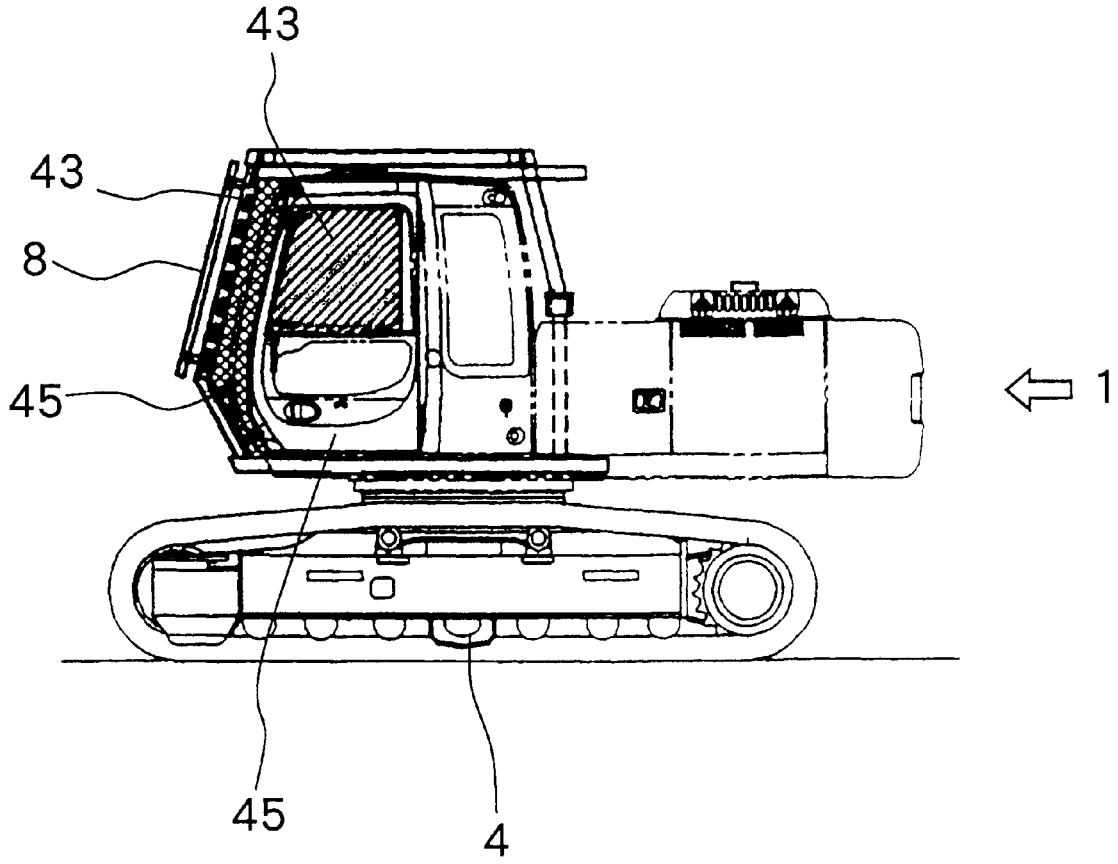
FIG. 30 is a right-hand side view of the example of the reinforced heavy vehicle.
Figure 31:
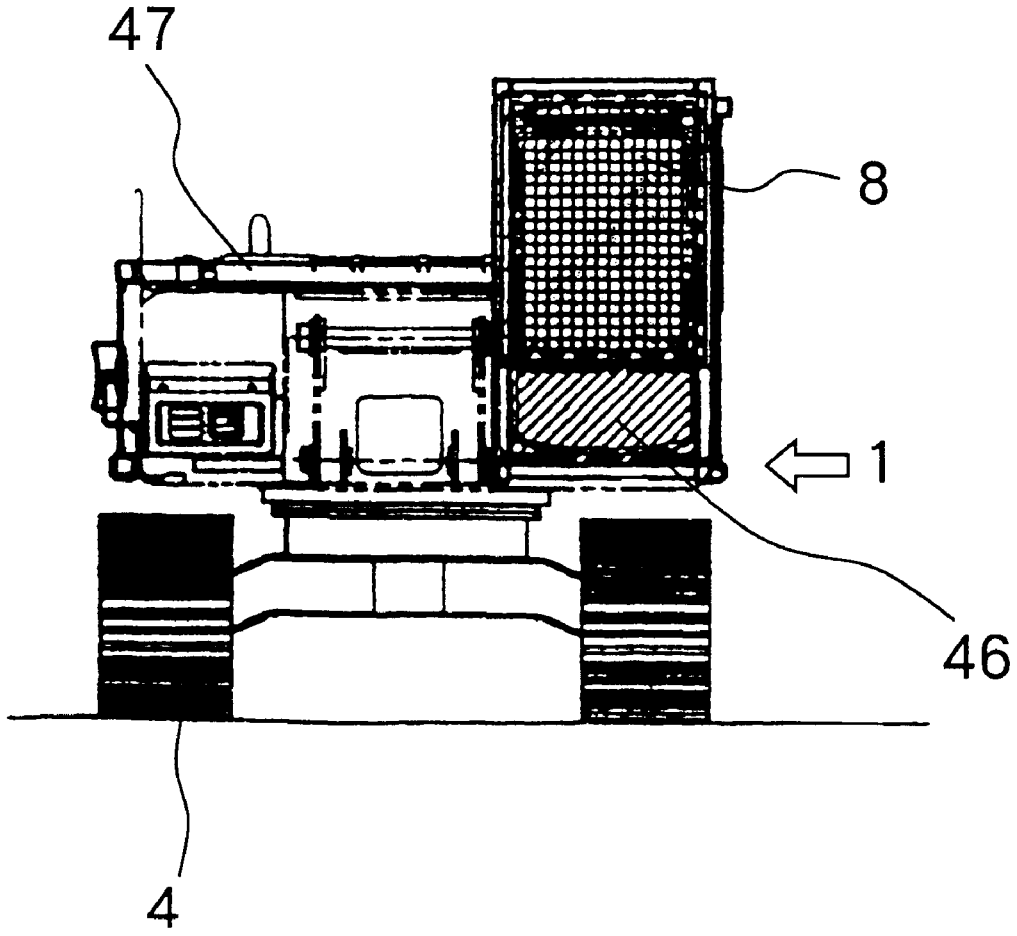
FIG. 31 is a front view of the example of the reinforced heavy vehicle.

The derrickable and foldable arm 2 is comprised of a boom 2*a*, an arm 2*b*, a boom cylinder 2*c*, an arm cylinder 2*d*, and a bucket cylinder 2*e*. A distal end of the arm 2 is provided with an attachment detachably-attaching device 5 having, at a distal end of a link mechanism 5*a*, a built-in screw handle type sliding mechanism 5*b* for varying a distance between members for holding pins 6 of the attachment. The attachment detachably-attaching device 5, which is a so-called quick hitch, is capable of recombining the attachments without pulling the pins 6. The details of recombining operation will be described with reference to FIGS. 26 and 27

The sliding mechanism 5*b* is comprised of a movable nail 5*c*, a lock bar 5*d* and a set screw 5*e*. The attachment is locked to the attachment detachably-attaching device 5 with a hydraulic hose disconnected, by firstly fitting the attachment detachably-attaching device 5 to one of the pins 6 of the attachment with the movable nail 5*c* contracted, secondly to the other of the pins 6, and then screwing the set screw 5*e* by a tool to move the lock bar 5*d*.

The derrickable and foldable arm 2 is usually about 8 m in length; however, it can be, although not shown in the drawing, changed to an elongated one (about 18300 mm), which is a so-called super long front, as another application example.

Out of glass windows of the driver's seat 3, a front glass and a floor glass each is made of a special bullet-proof glass 7 comprising a 27-mm-laminated bullet-proof glass of polycarbonate plates, to have a strength of about 200 times that of a normal glass. In addition, a guard 8 comprising a 50-mm-mesh steel-made net body is disposed on the front side. Although not shown in the drawing, iron-made under covers are disposed under a main body of the heavy vehicle and a truck to guard the inside of their machines.

Alternatively, the heavy vehicle (base machine) 1 can be reinforced as shown in FIGS. 28 to 31 other than the above-mentioned under covers, and hence it can be provided with a side guard 42 made of a high-tension iron plate (80 kgf/cm$^2$), a wrecks guard 43, a cell guard 44, a cab side guard 45, a floor guard 46, a support beam 47, etc.

Figure 34:
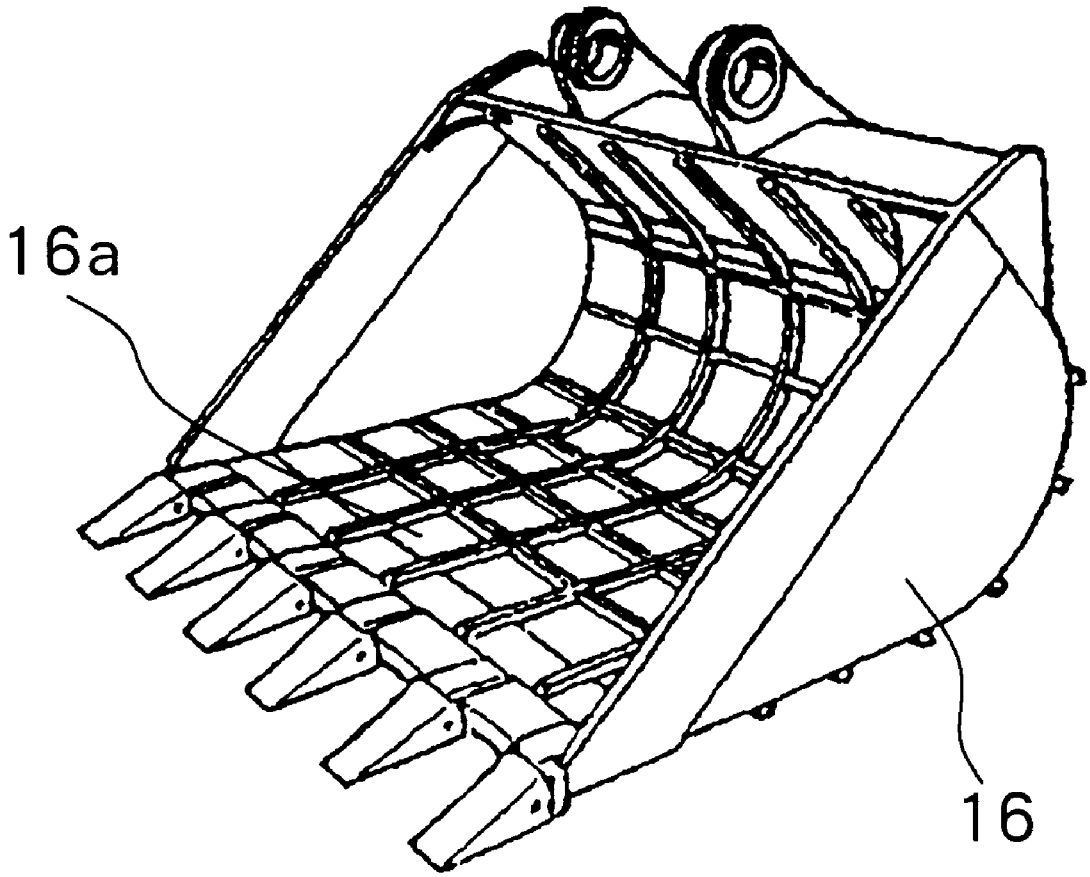
FIG. 34 is a perspective view of a skeleton bucket.

An attachment attached to the distal end of the derrickable and foldable arm 2 through the attachment detachably-attaching device 5 is comprised of a rotary cutter 9 comprising a rotational drum 10 having cutter bits 11 embedded at a circumferential face of the rotational drum 10 at suitable intervals, and a skeleton bucket 16 having a grating construction 16*a*, shown in FIG. 34.

Figure 15:
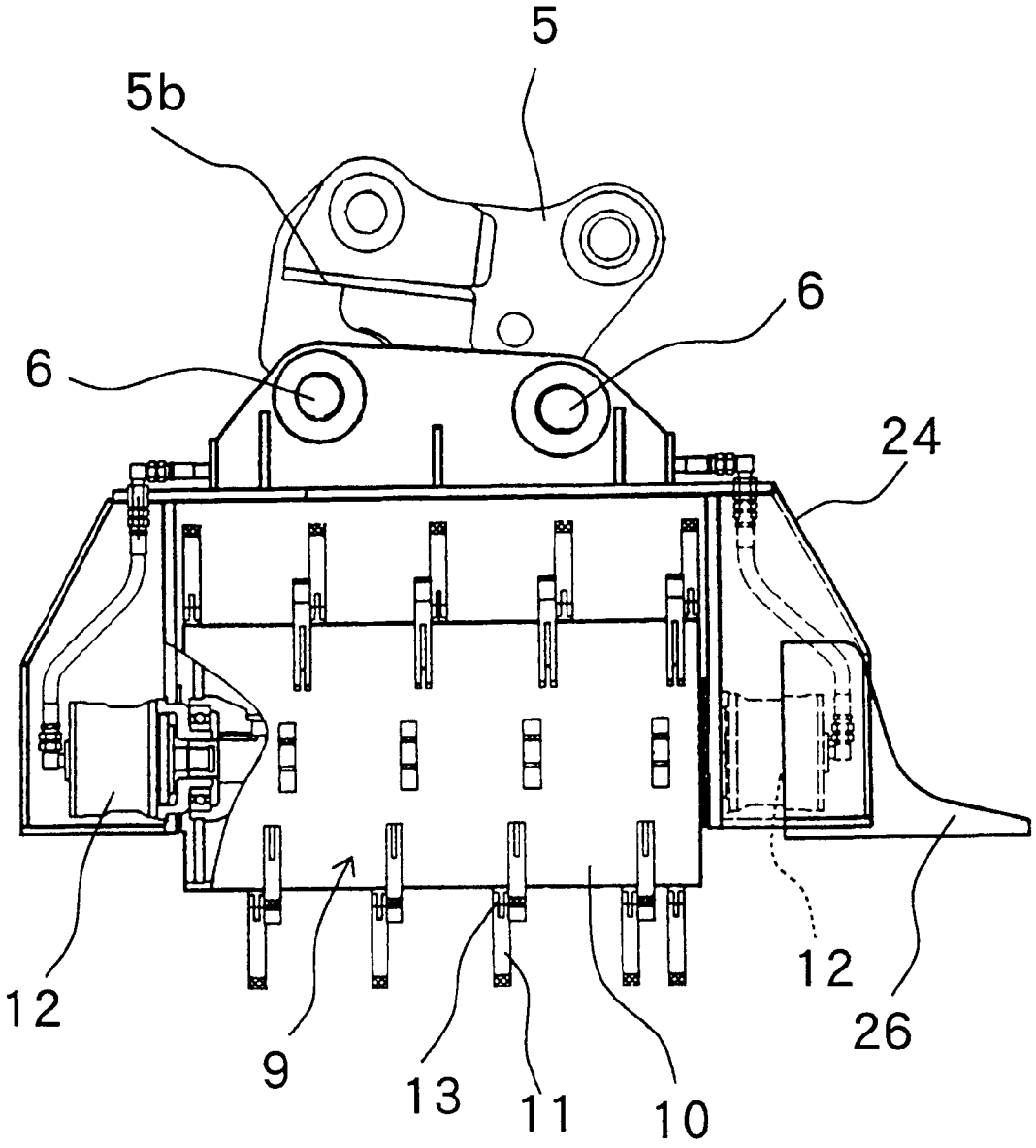
FIG. 15 is a front view of a rotary cutter portion of the mine disposal apparatus according to the present invention.
Figure 16:
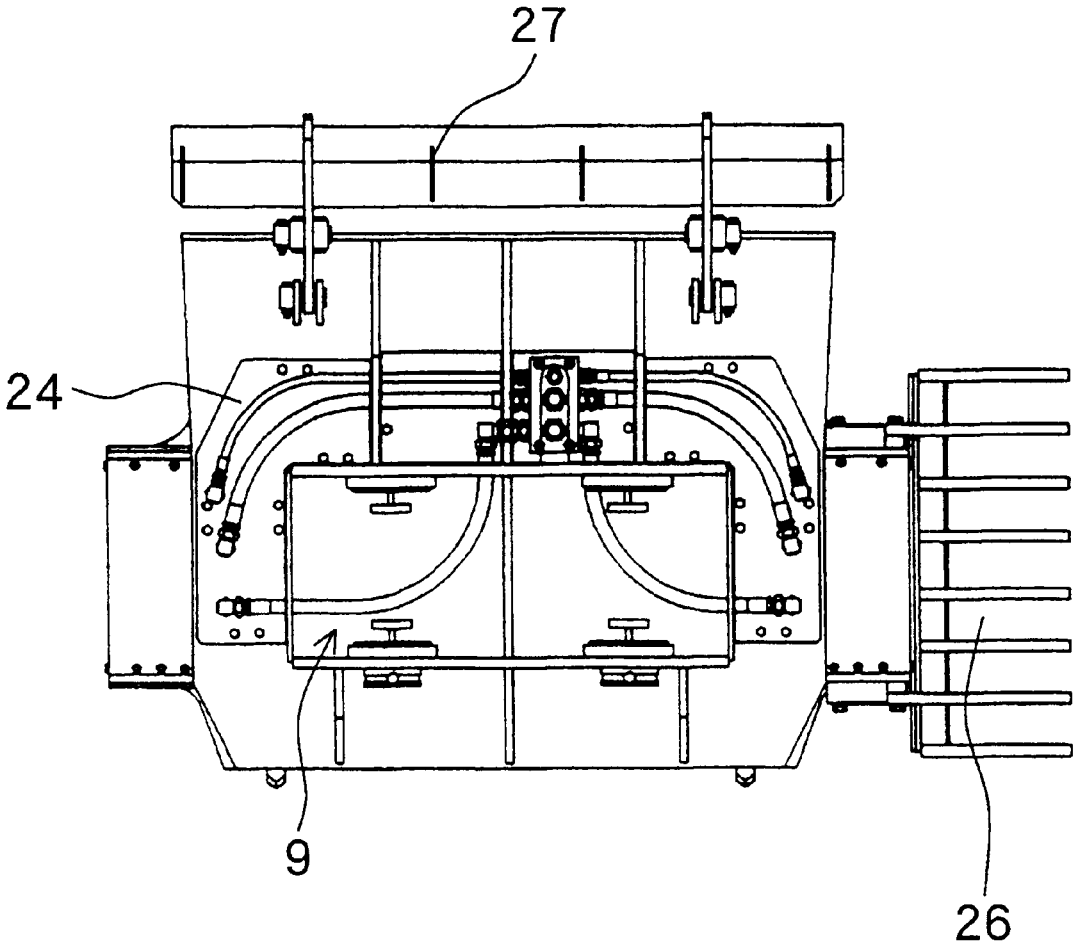
FIG. 16 is a plan view of the rotary cutter portion of the mine disposal apparatus according to the present invention.

The rotary cutter 9 is, as shown in FIGS. 15 and 16, of a hydraulic motor directly coupled type, and has driving motors 12 on left and right sides portions of the rotary cutter 9, which are connected to a rotational shaft of the rotational drum 10.

Figure 17:
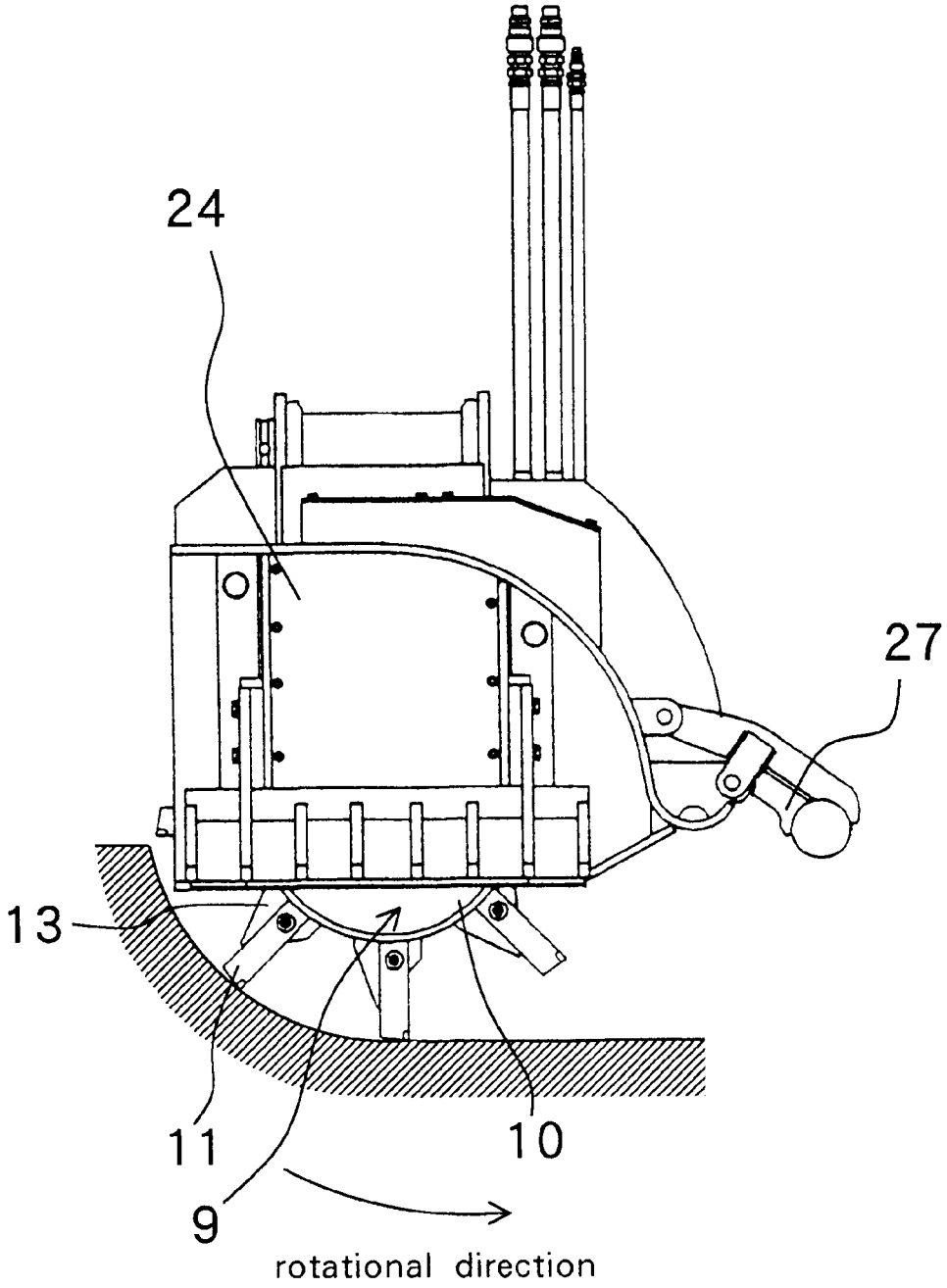
FIG. 17 is a side view of the rotary cutter portion of the mine disposal apparatus according to the present invention, in which mines are disposed.
Figure 18:
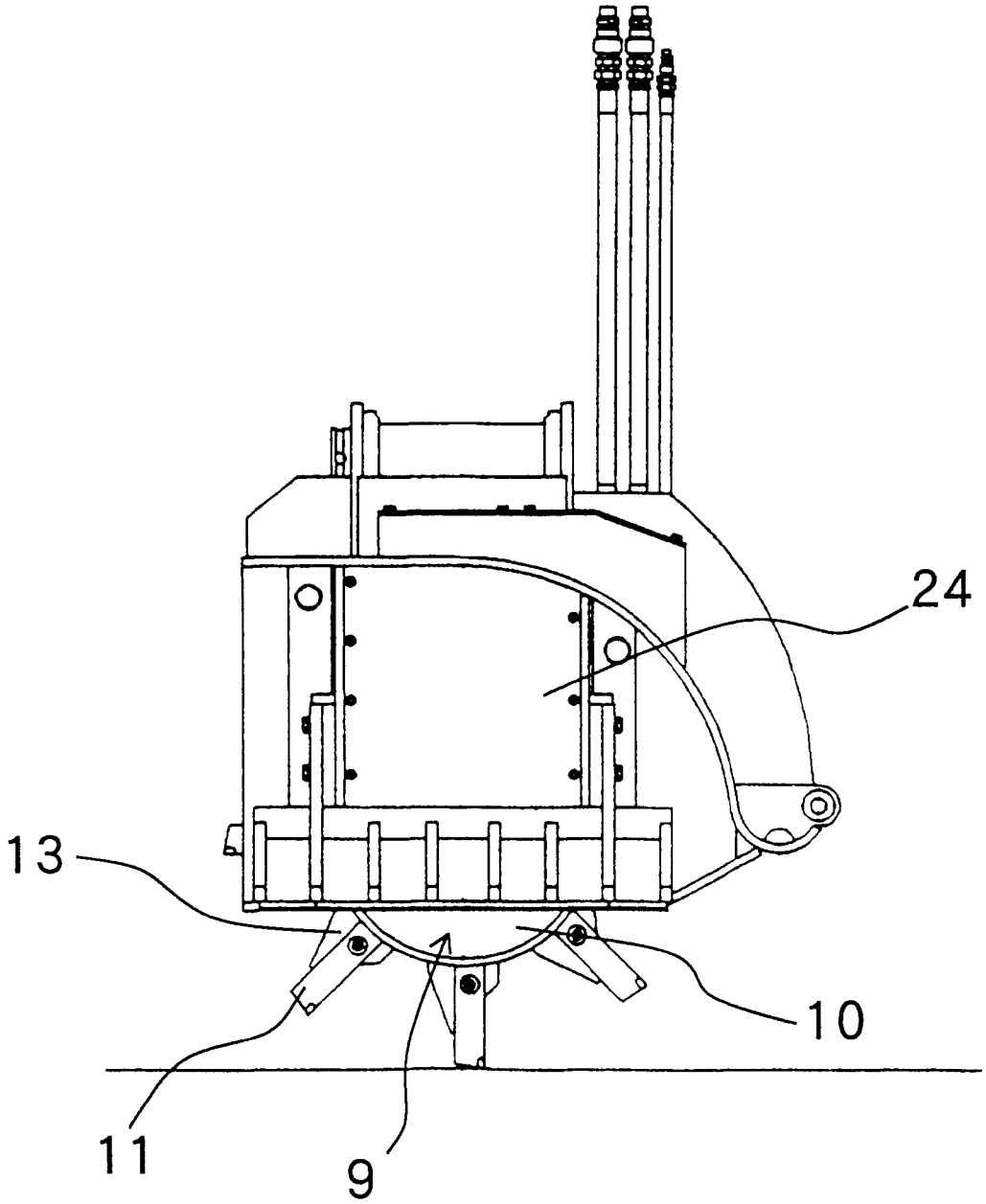
FIG. 18 is a plan view of the rotary cutter portion of the mine disposal apparatus according to the present invention, in which bush is disposed.
Figure 19:
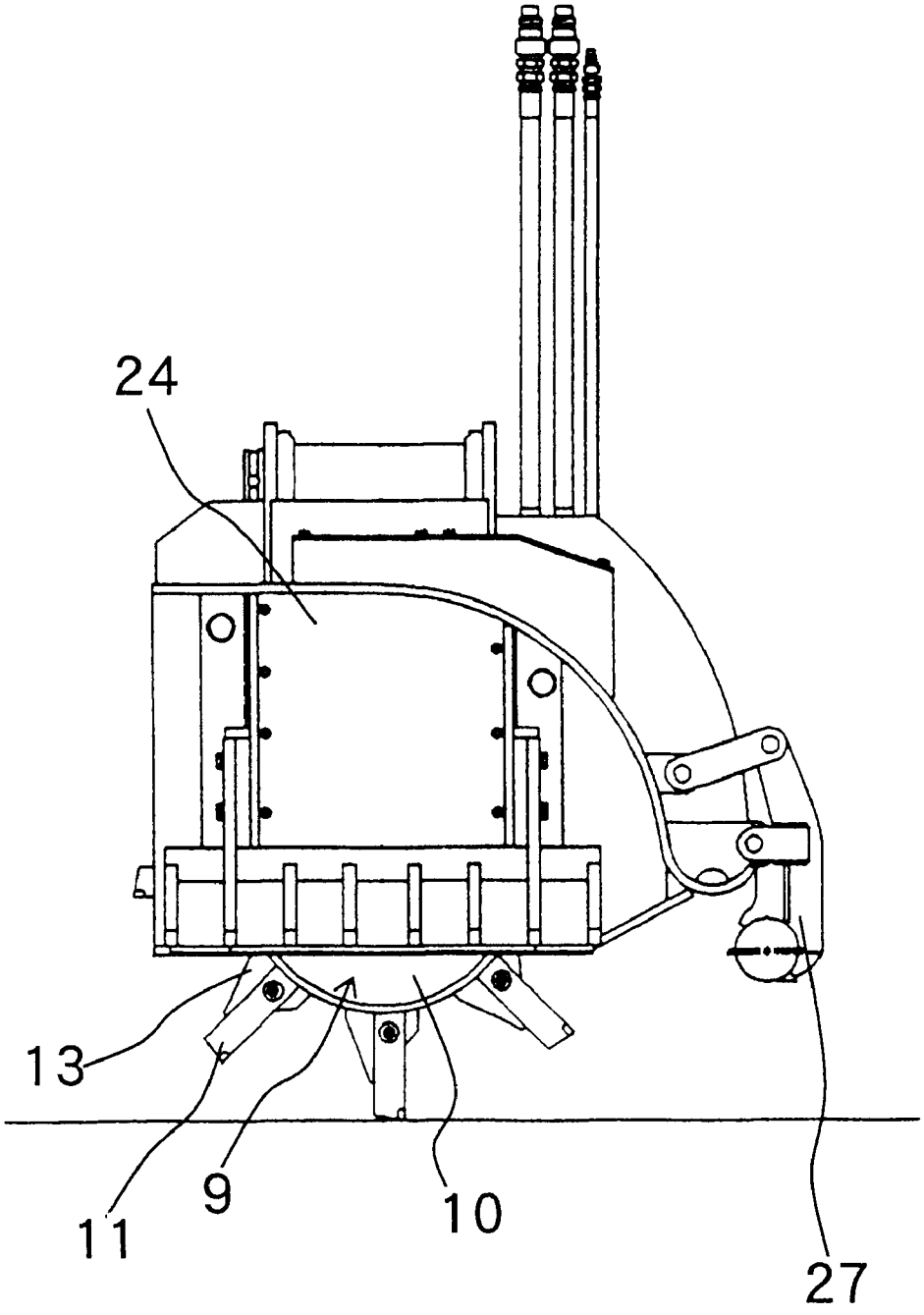
FIG. 19 is a side view of the rotary cutter portion of the mine disposal apparatus according to the present invention, in which farmlands are disposed.

Further, the rotary cutter 9 has a protruding rateau 28 at a side portion thereof, and also has a flap type scattering preventing blade 27 at a back side thereof. The scattering preventing blade 27 can be changed in opening and closing angle as shown in FIGS. 17 to 19. FIG. 17 shows a scattering preventing condition at the time of mine disposal described later, FIG. 18 shows a case in which bush is disposed, and FIG. 19 is a case in which farmlands are improved.

Figure 20:
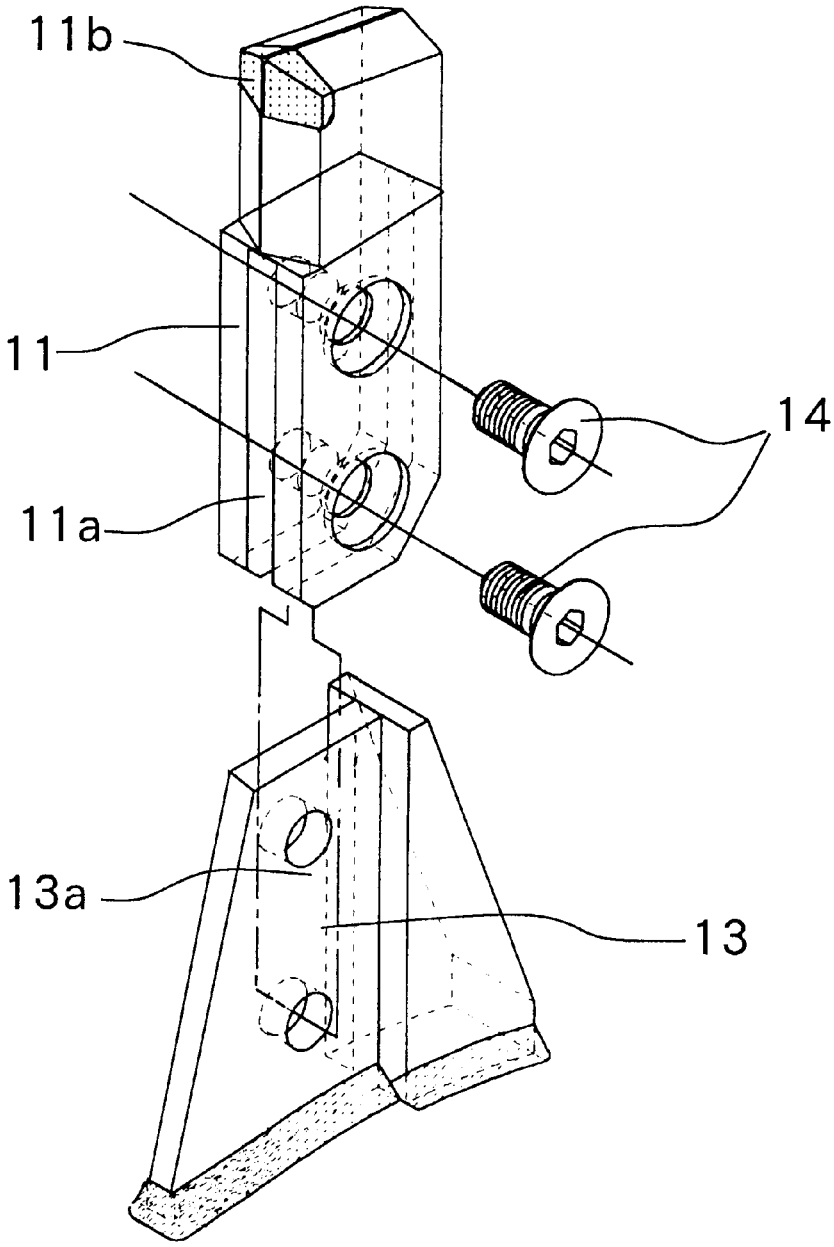
FIG. 20 is a perspective view of a cutter holder and a cutter bit of the rotary cutter.

Also, the cutter bits 11 of the rotaty cutter 9 are made of carbon steel and then fastened to cutter holders 13 by bolts 14, which cutter holders 13 are, as shown in FIG. 20, welded on the circumferential face of the rotational drum 10. The cutter bit 11 has, at a lower end thereof, a fork portion 11*a* which is fitted in a central thin portion 13*a* of the cutter holder 13 with the bolts 14 penetrated. The cutter holder 13 is large or thick at a back ward portion thereof with respect to the rotating direction of the rotary cutter 9 to raise its strength, making it possible to receive a bending stress and an impact load applied through the cutter bit 11.

Figure 21:
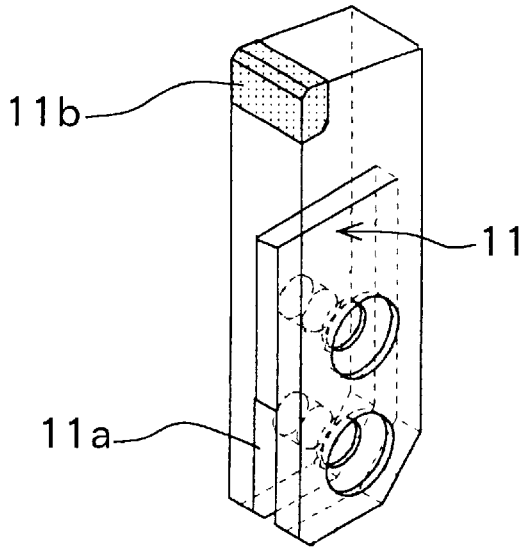
FIG. 21 is a perspective view of another example of the cutter bit of the cutter holder.
Figure 22:
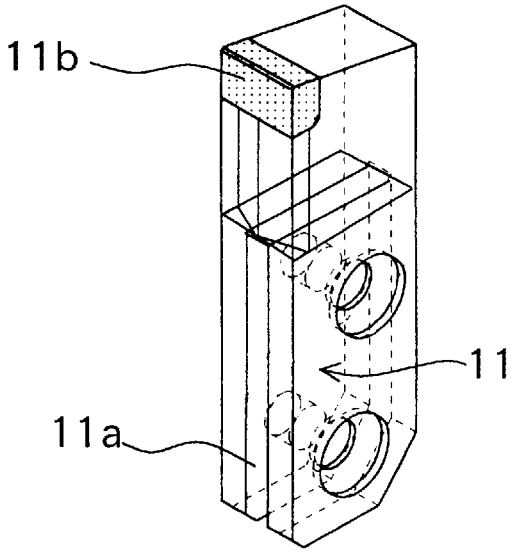
FIG. 22 is a perspective view of still another example of the cutter bit of the cutter holder.

In FIG. 20, reference numeral 11*b* designates a comented carbide tip 11*b*. The cemented carbide tip 11*b* of the cutter bit 11 can be selected from not only a sword tip type one shown in FIG. 20 but also a flat H-shaped type one and flat I-shaped type one shown in FIGS. 21 and 22.

Figure 32:
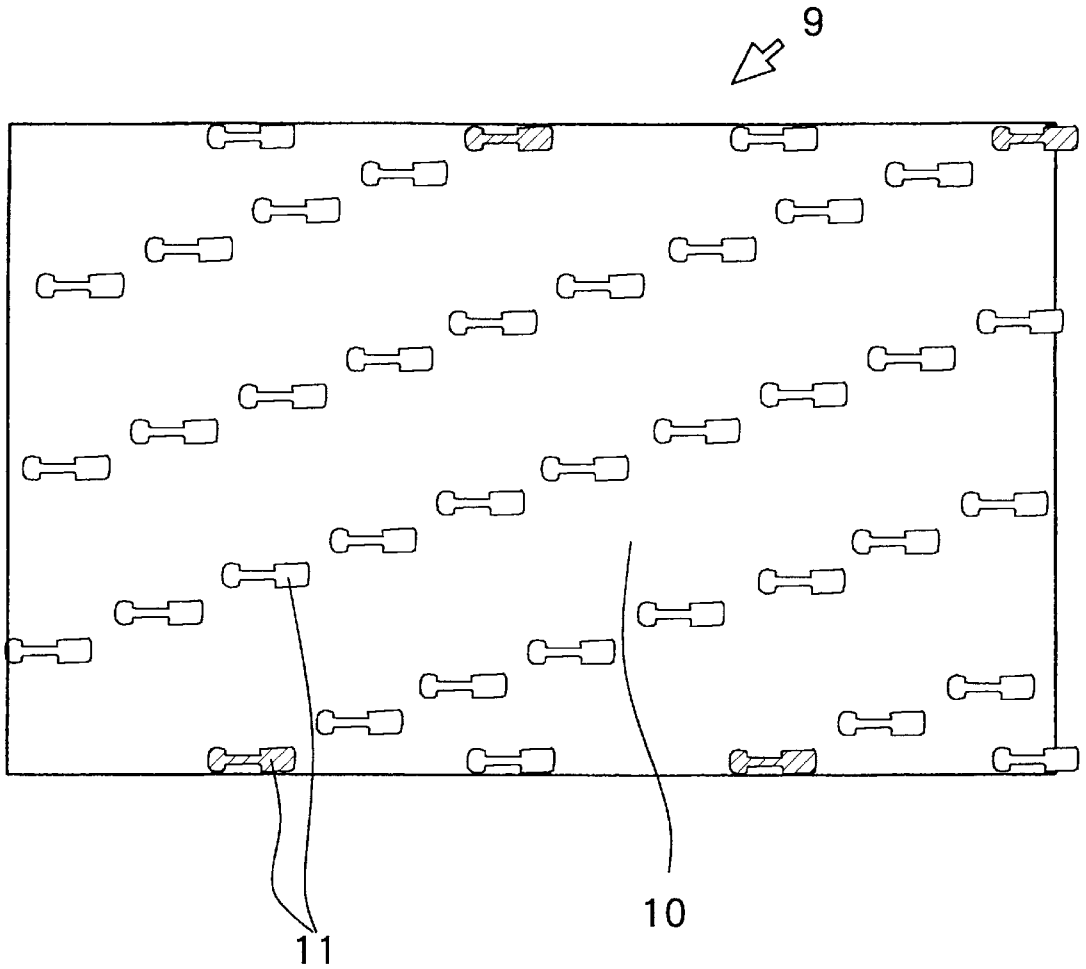
FIG. 32 is an exploded view showing an arrangement of the cutter bits of the rotary cutter.
Figure 33:
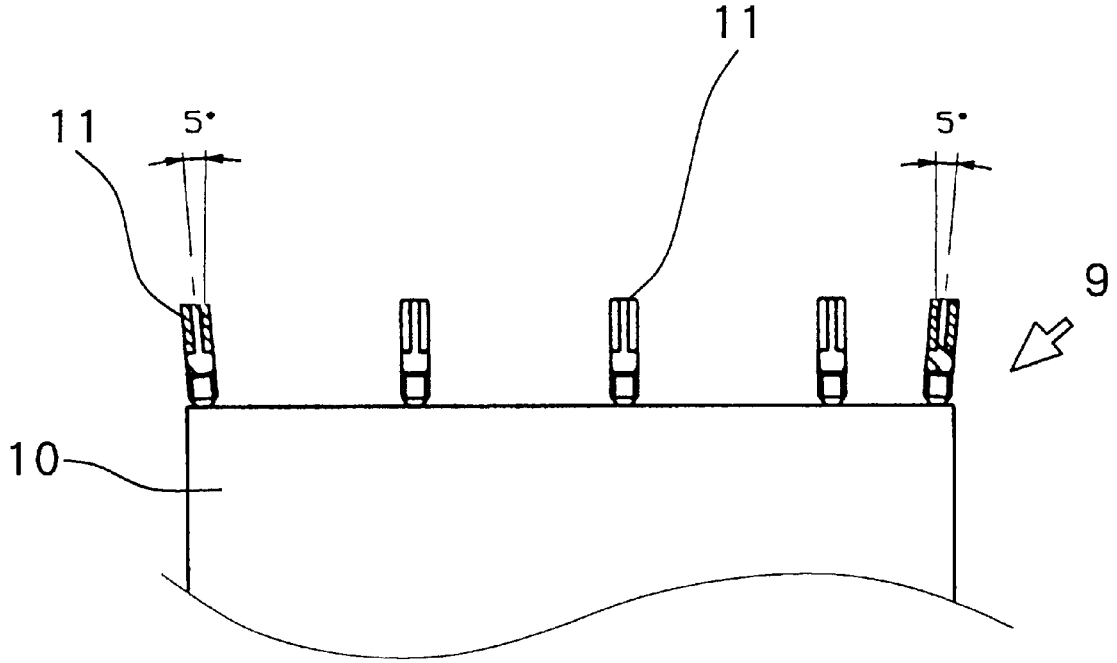
FIG. 33 is a view useful in explaining an arrangement of the cutter bits of the rotary cutter.

There is shown in FIGS. 32 and 33 a manner of arranging the cutter holders 13 and the cutter bits 11 on the rotational drum 10 of the rotary cutter 9. They are arranged obliquely to the rotational shaft of the rotational drum 10, and spirally in such a manner that the spirally winding direction corresponds to the rotational axis. The total number of the cutter bits 11 is 40 in this embodiment. Two on each side, i.e., total four of the cutter bits 11 which are arranged at hatching portions of the drawings are inclined on one side as shown in FIG. 33.

About two-third of the rotary cutter 9 is housed in a hood 24, and about the lower one-third is exposed. The rotary cutter 9, of e.g. a cutting outer diameter ϕ800–900 mm, a rotational speed 500–650 rpm, a maximum torque 128 kg·m, a maximum cutting speed (distal end) 85–110 km/h, a cutting force of the cutting blade distal end 284–319 kg, a nominal pressure 280 kg/cm$^2$, a nominal flow rate 165–210 1/min, a nominal output 107 kw, a mass (cutter) 1400–2000 kg, is capable of cutting up to a depth of about 30 cm or more. The rotary cutter 9 has a turning radius of not less than about two times, and has a cutting depth of not less than six times that of the mine disposal apparatus shown in the above-mentioned conventional example of Japanese Provisional Patent Publication (Kokai) No. 8-320199.

The cutter bits 11 are arranged in a spiral manner, providing a screw effect in cutting, and preventing bush, etc., from tangling therewith. When the rotary cutter 9 is reversely rotated, providing an effect of removing earth sideways.

Also, the rotary cutter 9 is, when its rotational axis is directed in parallel with the heavy vehicle 1, rotated in an anti-clockwise direction, i.e., in a reverse direction of a traveling (forward) direction of the heavy vehicle 1 as shown in FIG. 17 to thereby remove the earth backward.

A sensor portion 17 comprising a radar type mine counter is attached to a distal end of the arm 2 at a side portion of the arm 2. The radar type mine counter is comprised of not only the sensor portion 17, but also a signal processing portion and a monitor-service CRT, although not shown in the drawings, disposed in the driver's cabin.

The sensor portion 17 is protractible by a jack type telescopic arm. The sensor portion 17 detects buried things within a depth of one meter under the ground and then identifies the material and the kind of the thing while moving on a predetermined condition based on the movement of the arm 2 and the jack type telescopic arm. The material, the location, and the depth are displayed on the CRT.

Figure 23:
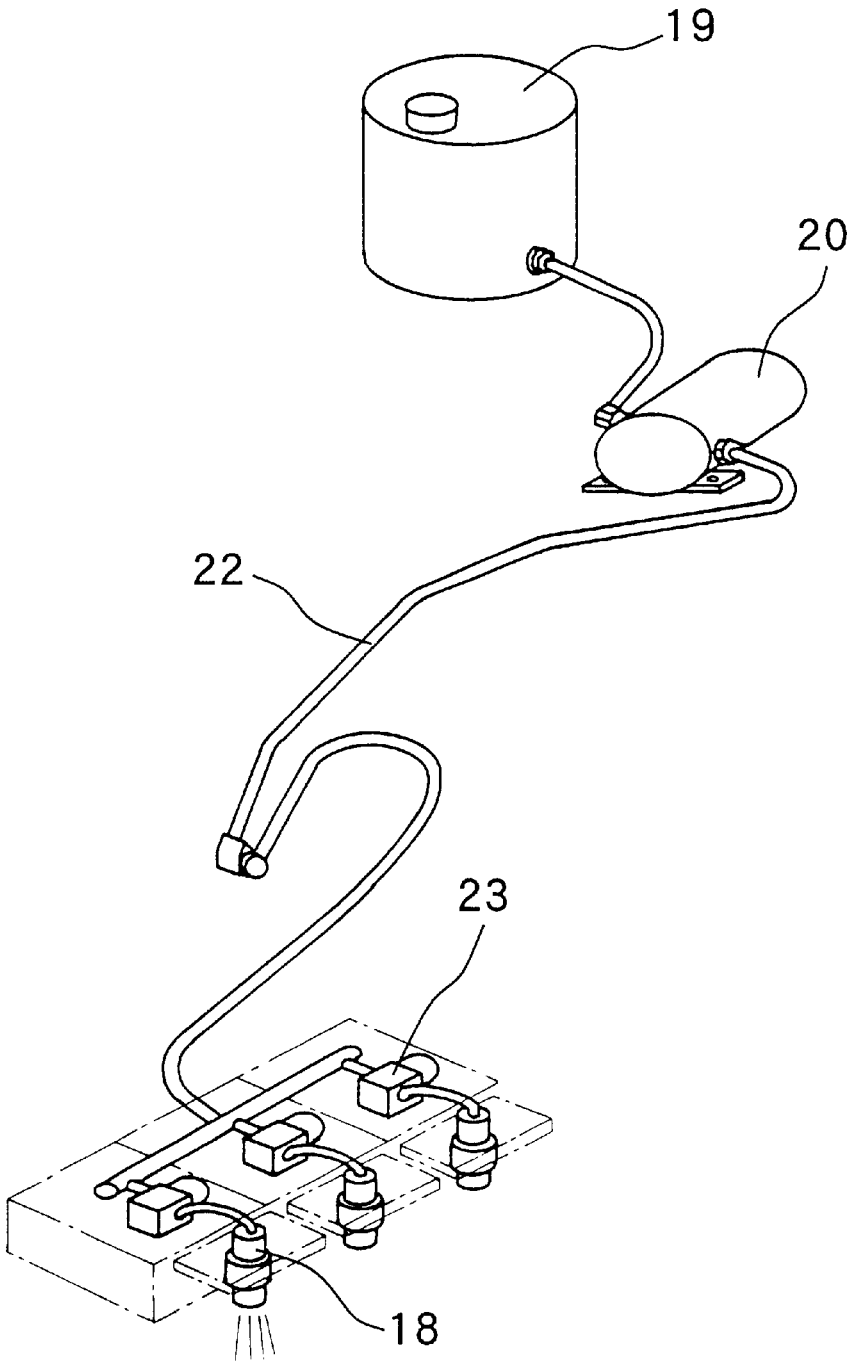
FIG. 23 is a view useful in explaining a marking system.

Also, an injecting nozzle 18 of a marking system is, as shown in FIG. 23, disposed in the vicinity of the sensor portion 17. The injecting nozzle 18 is provided with a changing-over electromagnetic valve 23 and connected to a colored water storage tank 19 through a conveying pipe 22 having an injecting pump 20 at an intermediate portion thereof. After the location is decided, injecting paint on the ground by this marking system enables the buried thing to be indicated.

The detecting device has two stages of a mode of detecting the presence of the buried thing, and a precision mode of making a correct information clear after the decision. The material of the detected buried thing is identified and displayed on the CRT.

Figure 24:
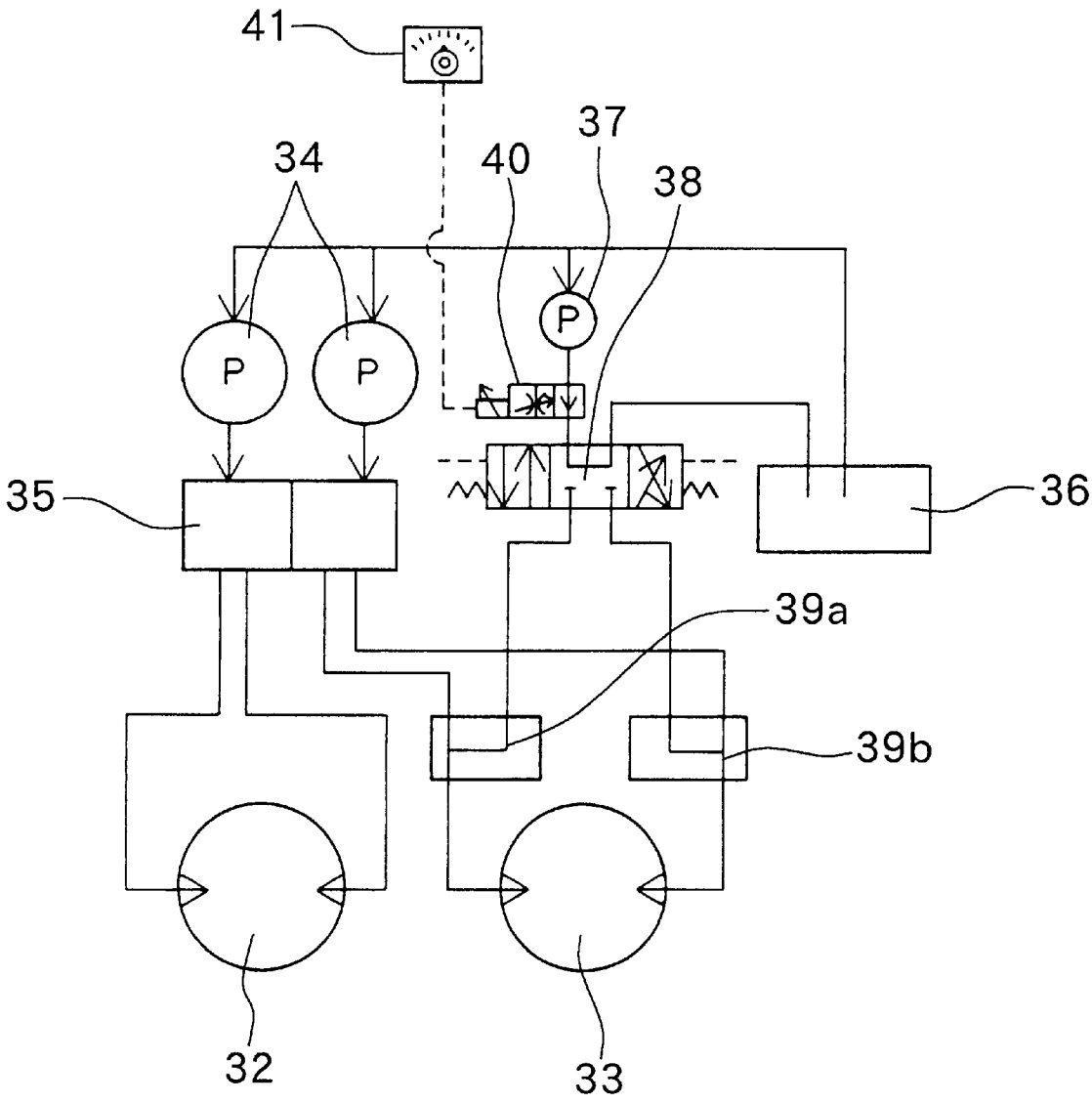
FIG. 24 is a hydraulic circuit.

In FIG. 24 showing a hydraulic circuit, reference numeral 32 designates a hydraulic motor for use in the rotary cutter 9, and 33 a hydraulic motor for use in for turning the main body such as the arm 3, etc. These hydraulic motors 32, 33 are associatively driven by changing-over the oil, transferred from a pressure-oil tank 36 through main pumps 34, by a main changing-over valve 35. On this occasion, the hydraulic motor 33 for turning the main body is changed in speed due to the load of the rotary cutter 9 and the operation angle of the operation lever, etc., disabling the main-body to turn at a uniform and constant speed. Similarly, the rotary cutter 9 is unbalanced in rotation.

In the present invention, there is provided another sub pump 37. The oil from the sub pump 37 distributed by a sub changing-over valve 38 and delivered to the hydraulic motors 32, 33 through confluence blocks 39, thereby causing the hydraulic motors 32, 33 to turn. Thus changing the confluence blocks 39 makes the system for use in the rotary cutter 9 and the system for use in turning the main body such as the arm 2, etc., relatively simple, and independent to each other, and then prevents the change of the rotational speed of the rotary cutter 9 in turning, which results in a uniform and sure work. In other words, the turning speed can be selected according to the work by flowing the oil to the hydraulic motor 33 for turning the main body from the circuits which are different in flow rate. Further, in the work required for the compound movement of the bucket, the initial function of the conventional hydraulic shovel are available as it is, which prevents the multiplicity such as cutting, etc., from being eliminated.

Besides, the addition of a proportional electromagnetic Valve 40 (with pressure compensating function) enables the turning speed to be adjusted optionally by a turning speed electric current adjusting dial 41 irrespective of the turning load pressure.

Moreover, the main changing-over valve 35 and the sub changing-over valve 38 may be of hydraulic type, and these valves 35, 38 may be selected and changed over by another electromagnetic valve using the same operating lever.

Figure 25:
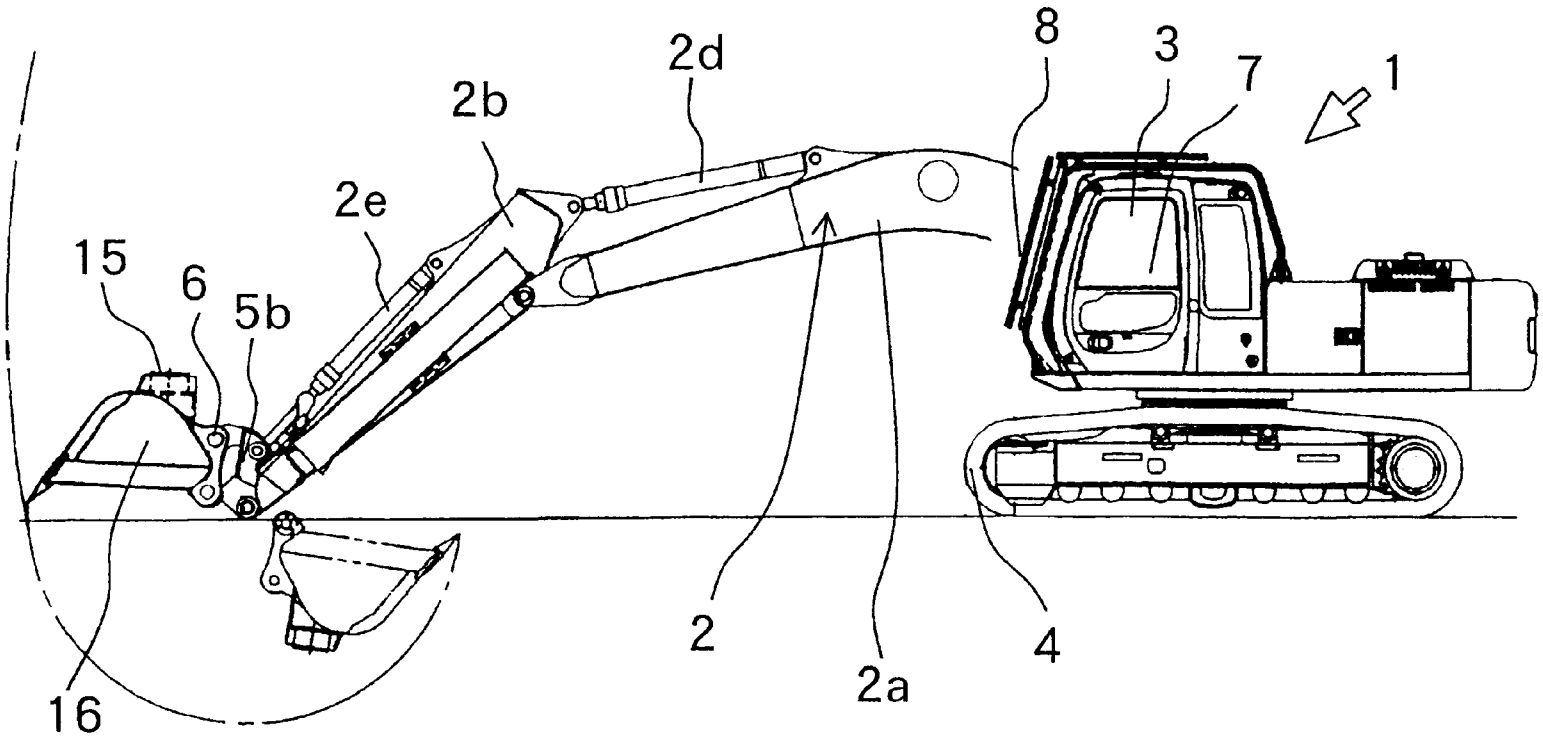
FIG. 25 is a side view of another example using a skeleton bucket.

As shown in FIG. 25, the skeleton bucket 16 having the grating structure 16a may have a magnet 15 at an outer side portion of a bottom thereof. The magnet 15 is an electromagnet, and then can be used for removing fragments such as unexploded shells described later.

Figure 35:
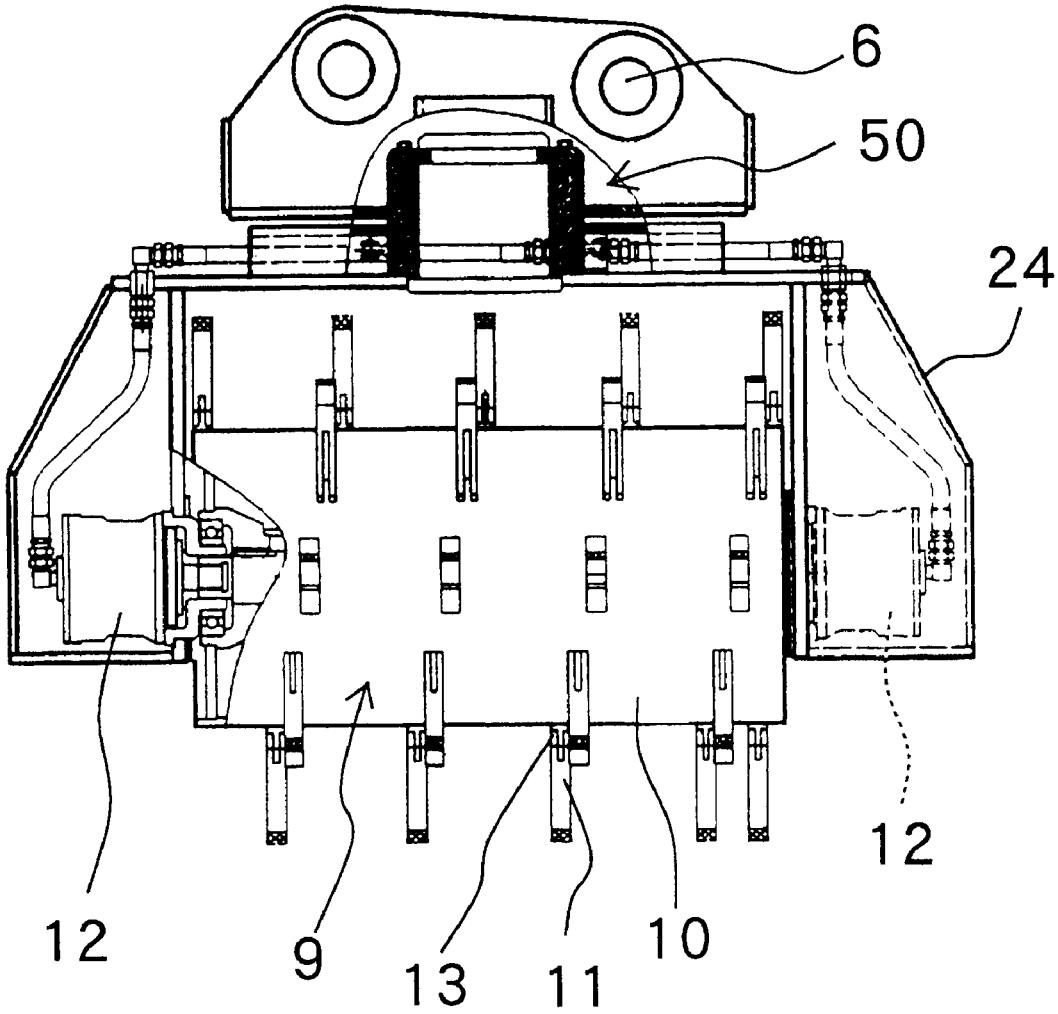
FIG. 35 is a front view of a second embodiment of the rotary cutter of the mine disposal apparatus according to the present invention.
Figure 36:
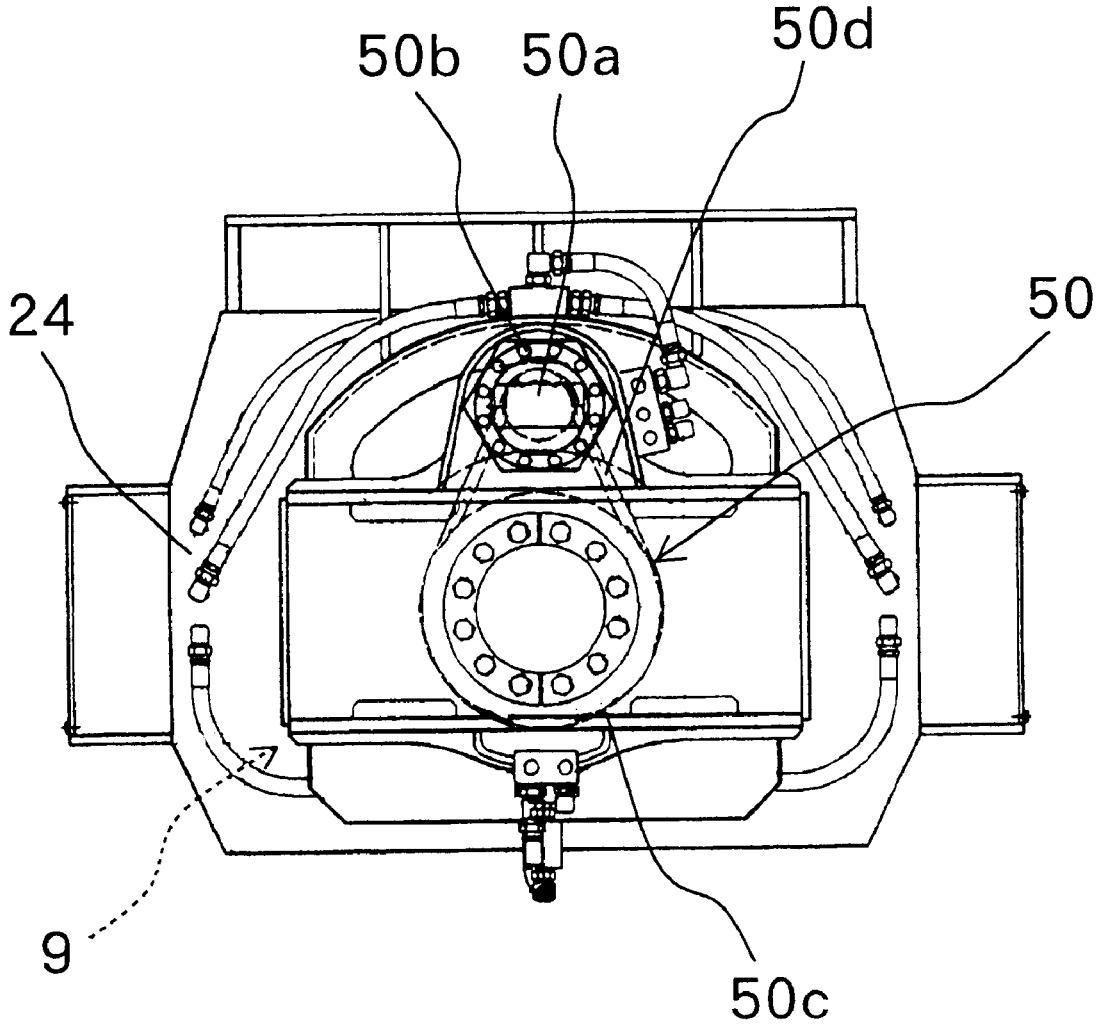
FIG. 36 is a plan view of the second embodiment of the rotary cutter of the mine disposal apparatus according to the present invention.
Figure 37:
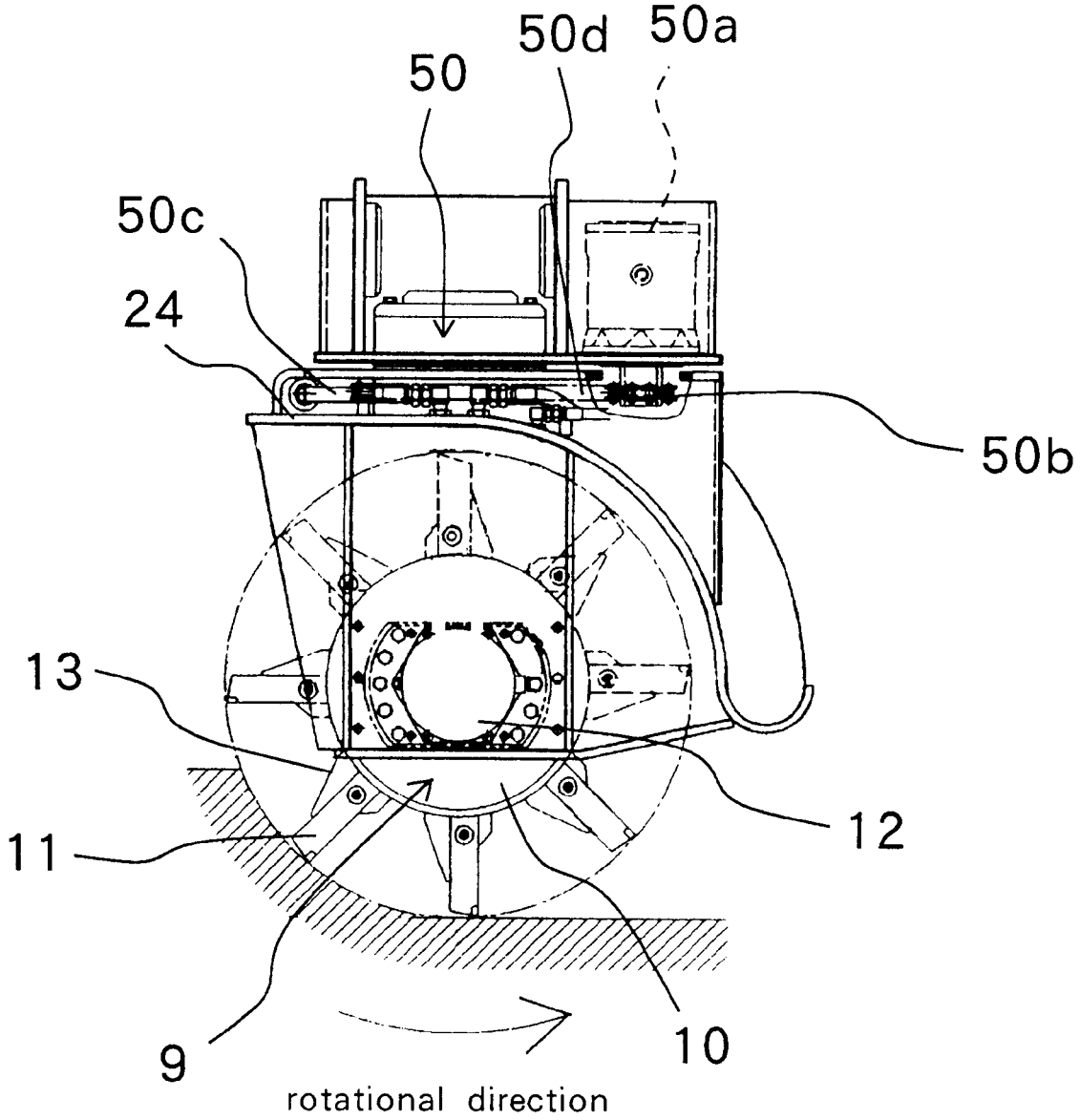
FIG. 37 is a side view of the second embodiment of the rotary cutter of the mine disposal apparatus according to the present invention.
Figure 38:
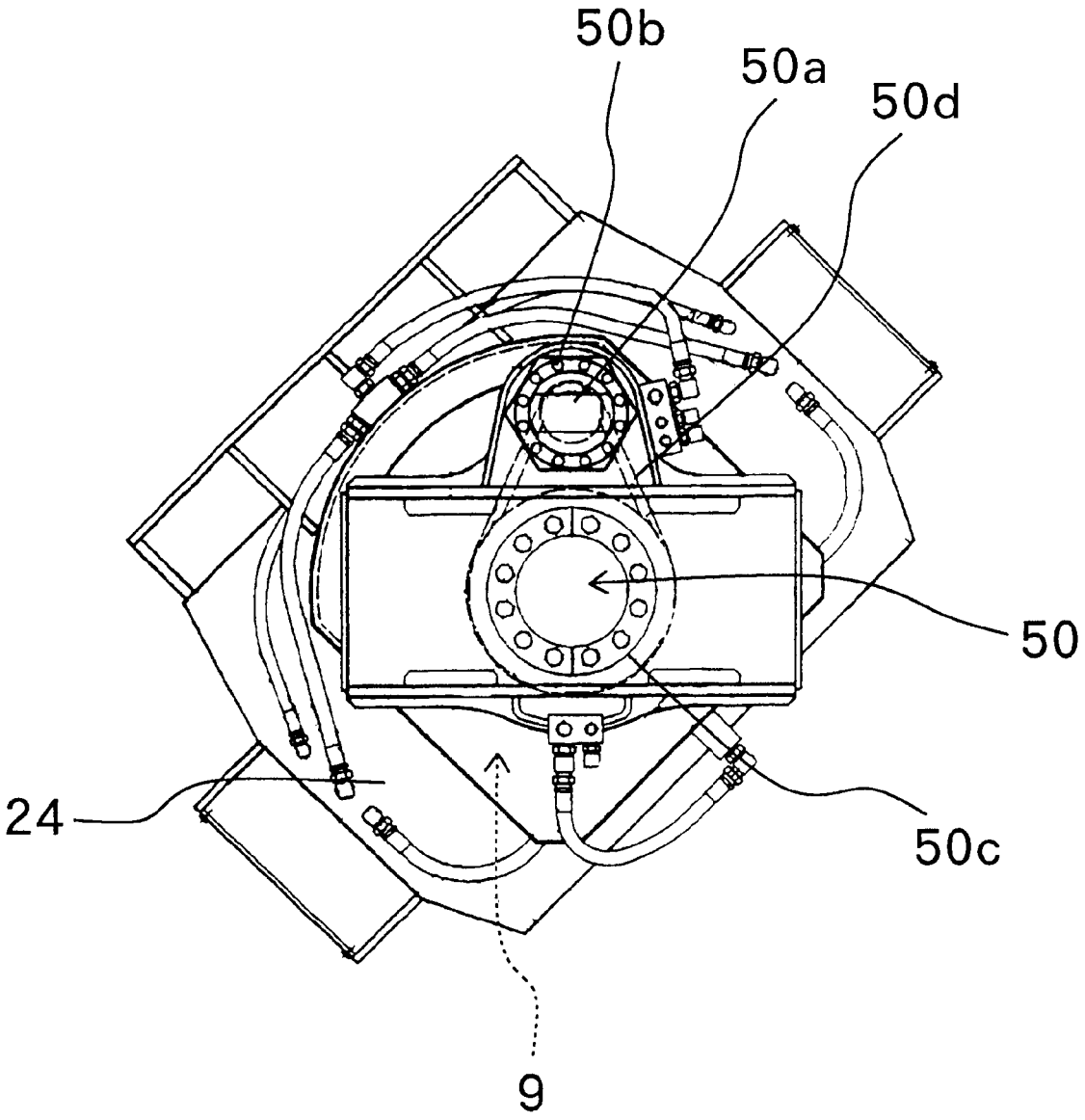
FIG. 38 is a plan view of the second embodiment of the rotary cutter while being turned left-hand by 45°.
Figure 39:
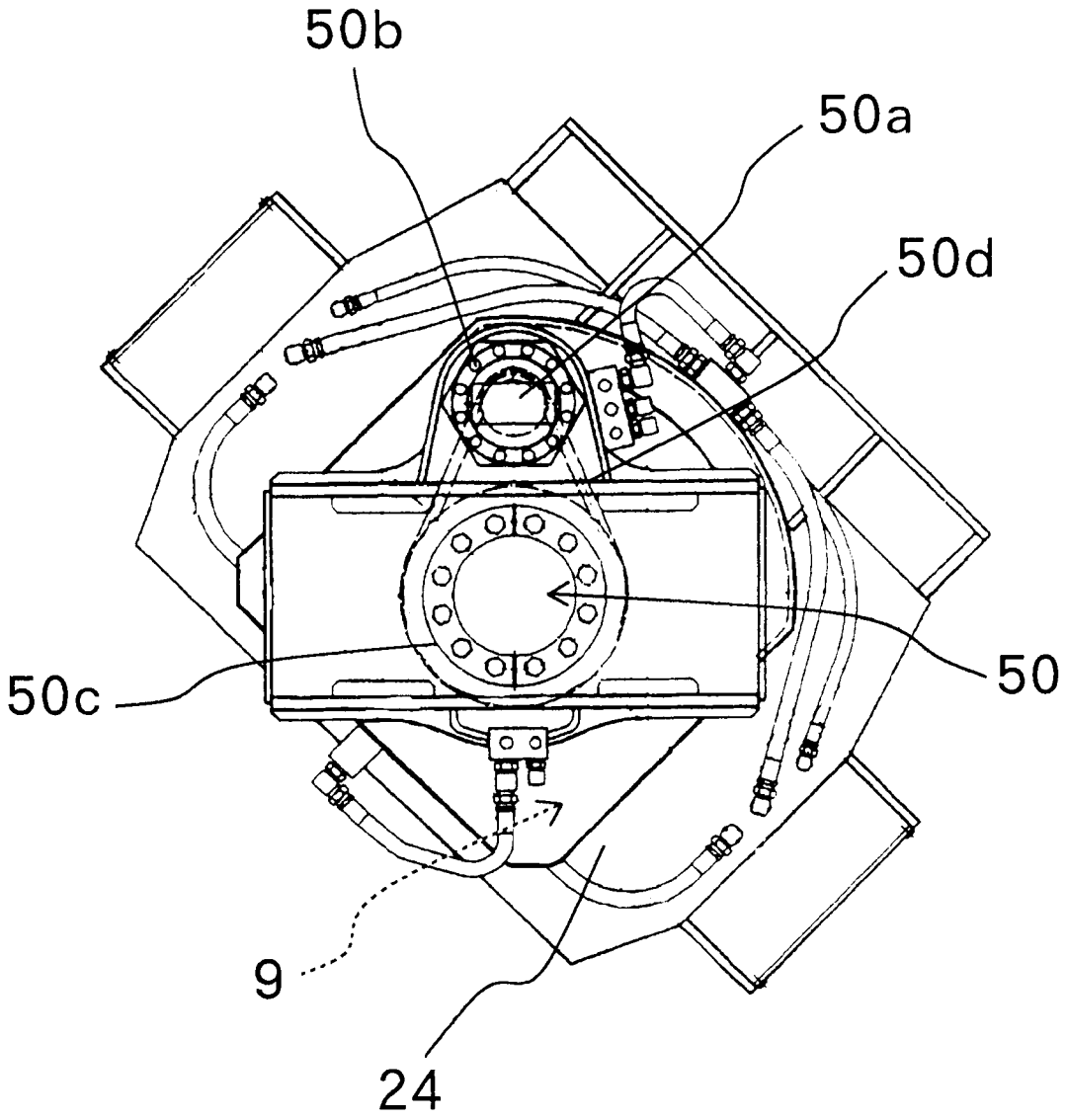
FIG. 39 is a plan view of the second embodiment of the rotary cutter while being turned right-hand by 45°.
Figure 40:
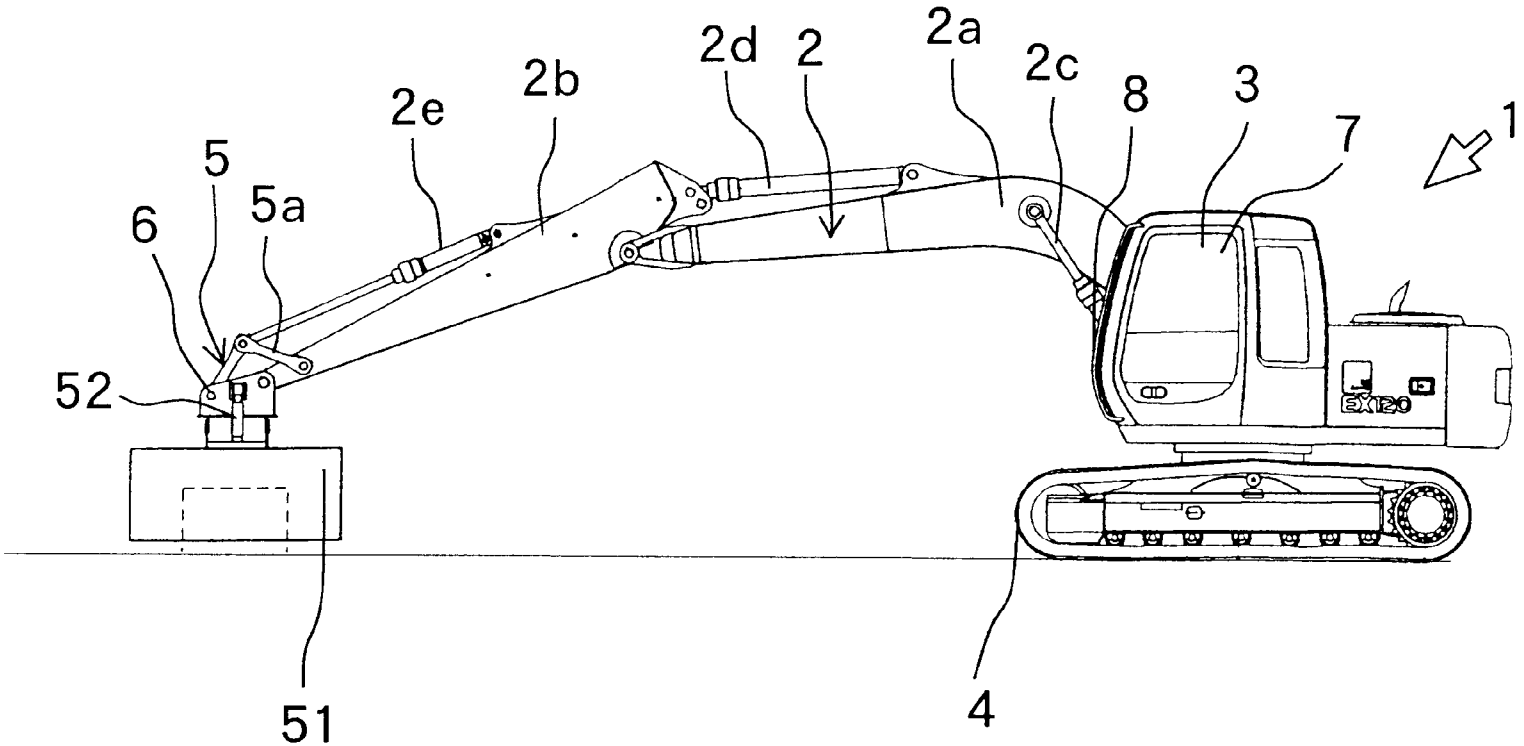
FIG. 40 is a side view of another embodiment of a mine detection apparatus portion of a mine disposal apparatus according to the present invention.
Figure 41:
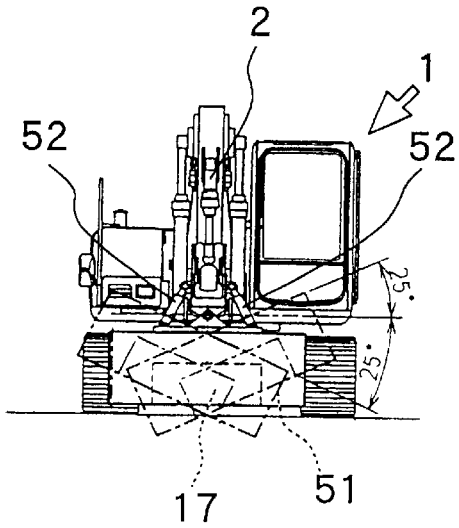
FIG. 41 is a front view of another embodiment of the mine detection apparatus portion of the mine disposal apparatus according to the present invention.
Figure 42:
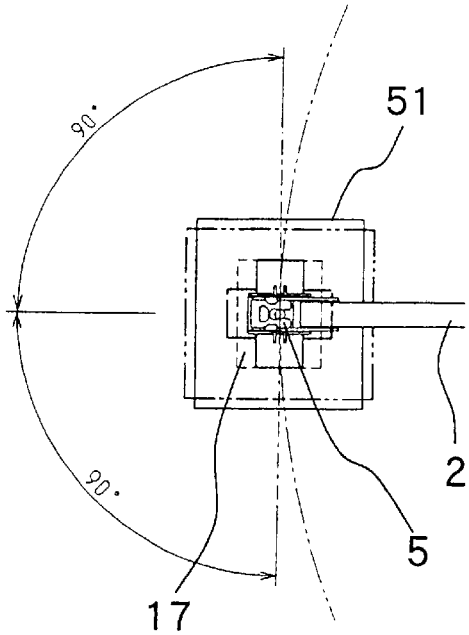
FIG. 42 is a plan view of another embodiment of the mine detection apparatus portion of the mine disposal apparatus according to the present invention.
Figure 43:
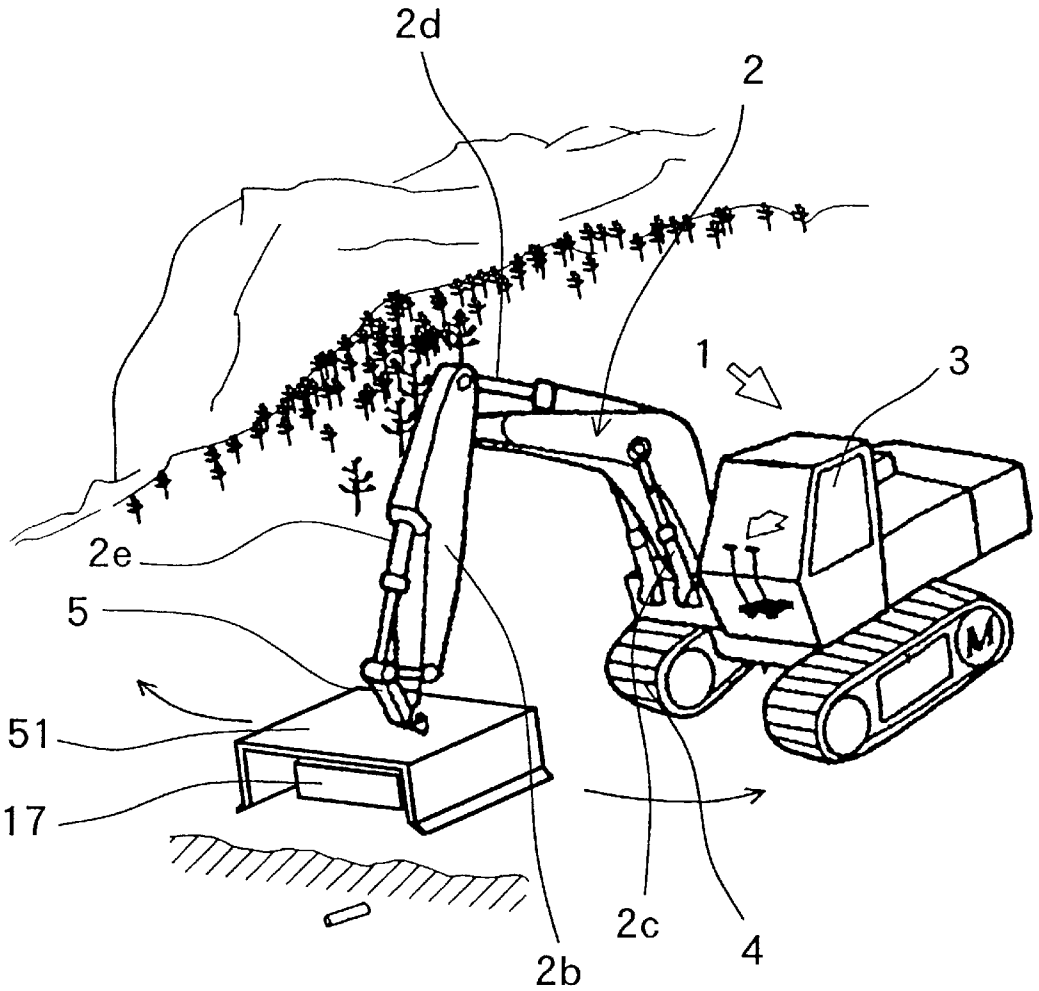
FIG. 43 is a perspective view of another embodiment of the mine detection apparatus portion of the mine disposal apparatus according to the present invention.

Alternatively as to another embodiment, as shown in FIGS. 35 to 37, the rotary cutter 9 may have, below the pins 6 with which the attachment detachably-attaching device 5 is engaged, a lower frame and a lower frame coupled to each other through a center pin as a rotational shaft mechanism, and then have a built-in left and right directionwise rotational mechanism 50 comprising a motor 50*a*, a sprockets 50*b*, 50*c*, and chain 50*d*. The rotational mechanism 50 rotates the rotary cutter 9 by 45° at a time in the left or the right direction as shown in FIGS. 38 and 39.

Thus constructed rotary cutter 9 is capable of rotating by 45° at a time in the left or the right direction at a distal end of the derrickable and foldable arm 2, which enables the rotary cutter 9 to be minutely positioned, e.g., the derrickable and foldable arm 2 obliquely forward extending with from the heavy vehicle 1 traveling on a road, and with the rotary cutter 9 moving in parallel with an edge of the road.

Figure 13:
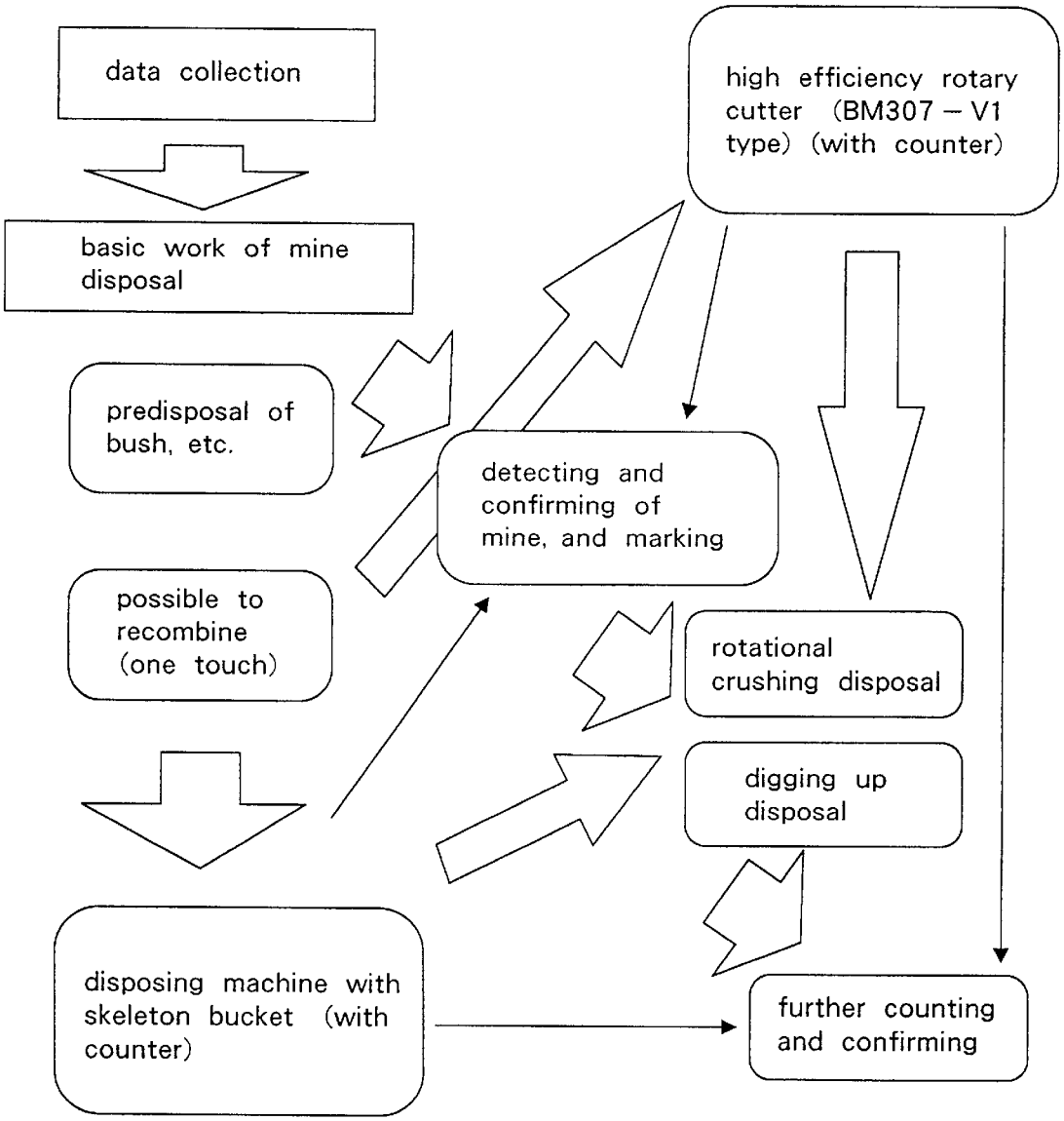
FIG. 13 is a block diagram generally showing mine disposal in the mine disposal apparatus and method according to the present invention.

Next, a mine disposal method according to the present invention using the above-mentioned mine disposal apparatus will be described hereinbelow, a block diagram of which is shown in FIG. 13. When the mine disposal apparatus (system) according to the present invention is used at a location where the mines are expected to be embedded based on the preliminary survey of various kinds of information, exhibiting the whole work efficiency requires a preliminary preparation work.

Figure 5:
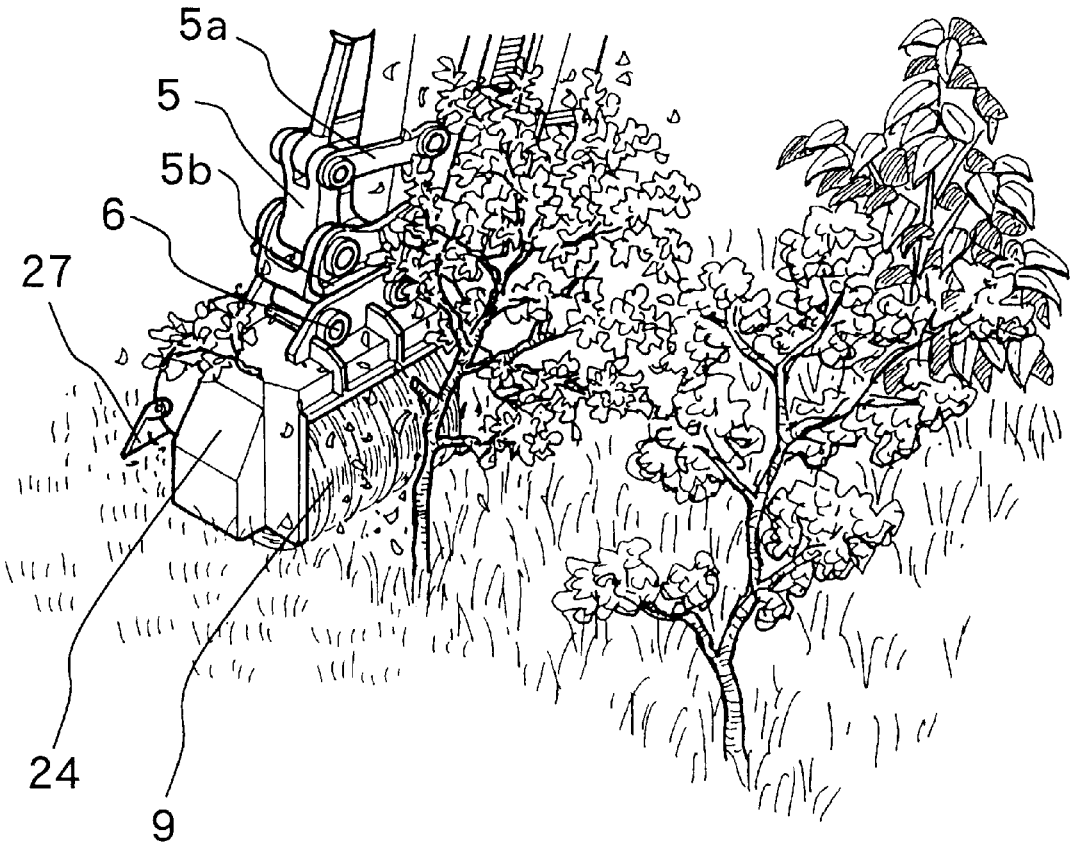
FIG. 5 is a view useful in explaining disposing standing crops in the mine disposal apparatus and method according to the present invention.
Figure 6:
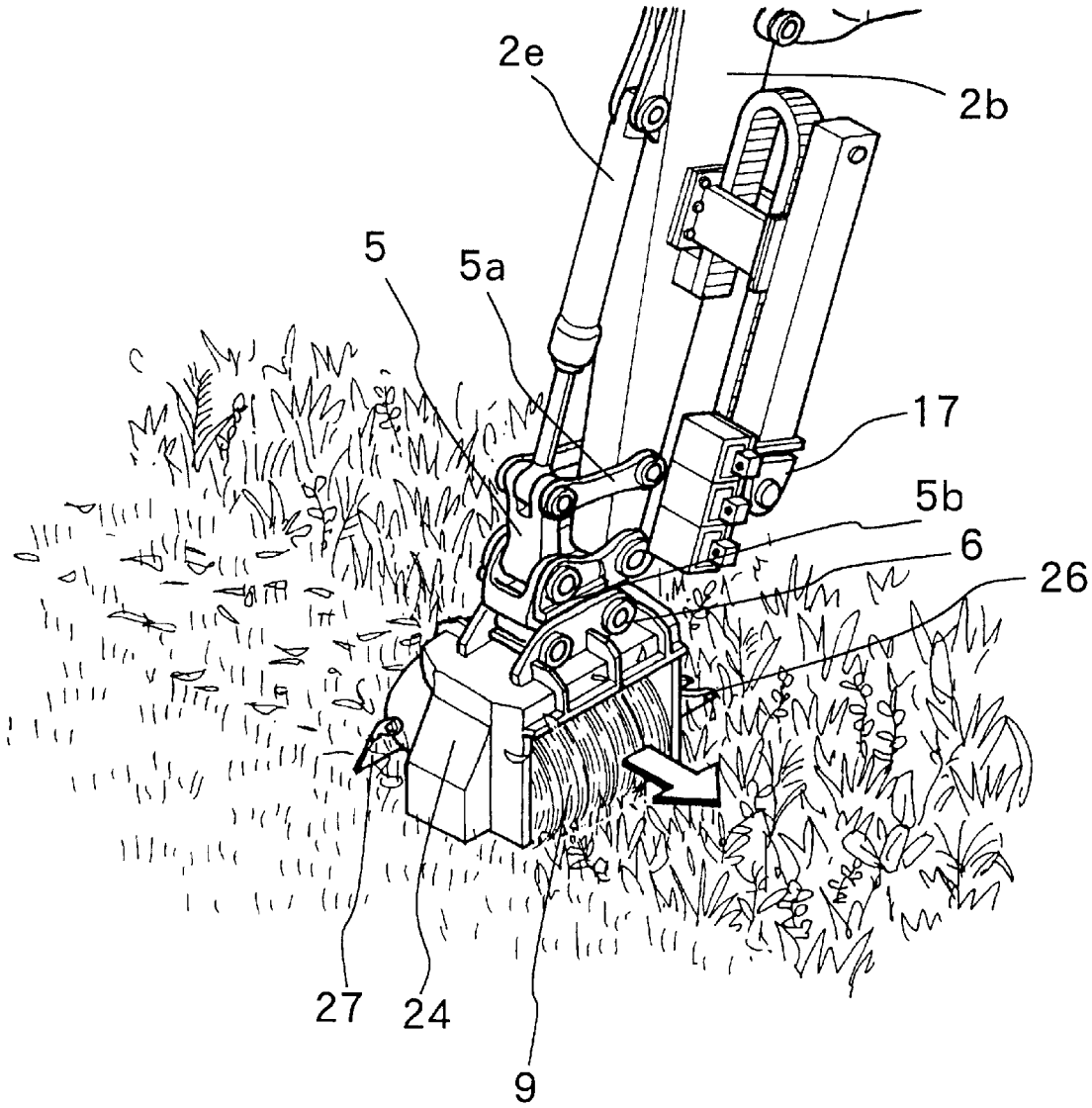
FIG. 6 is a view useful in explaining removing bush in the mine disposal apparatus and method according to the present invention.

First, the working location is confirmed. A reference post is put up at a starting point of the work, and the location of the post is plotted based on the definite surveying point, which is important for preparing the work record, the report, and the mine disposal map. Next, the work sections are set, an order of which are planed taking account of suitable replacement of the rotary cutter 9 or the skeleton bucket 16 as an attachment according to the geography and the vegetation in order to enhance the work efficiency. The heavy vehicle 1 advances, retreats and turns by the use of the caterpillars 4 or the wheels 25. An operator sits on the driver's seat 3 to operate the rotary cutter 9 or the skeleton bucket 16 by the use of the derrickable and foldable arm 2. When trees, shrub, ditch reed, grass covering the ground obstruct the detecting work and the disposing work for the mine, etc., these are preliminarily removed. As shown in FIGS. 5 and 6, the rotary cutter 9 moving laterally while turning enables shrub, ditch reed, and grass to be easily disposed. FIG. 5 shows a case in which standing crops are disposed, and FIG. 6 shows a case in which shrub is removed.

However, when the unexploded shell is expected to be embedded in the ground under cover of vegetation to make it difficult to make a visual identification before working, the safety is ensured at the working step. The first step is to cut the vegetation at a height of 30 to 40 cm above the ground so as not to bring contact to the unexploded shell, followed by confirming the presence of the unexploded shell on the ground. If the exploded shell is found out, the use of the rateau on a front portion of the rotary cutter causes the exploded shell to be safely picked up and then removed in the rear of the machine main body. Thereafter, it is transported by manual works, and then disposed.

Figure 7:
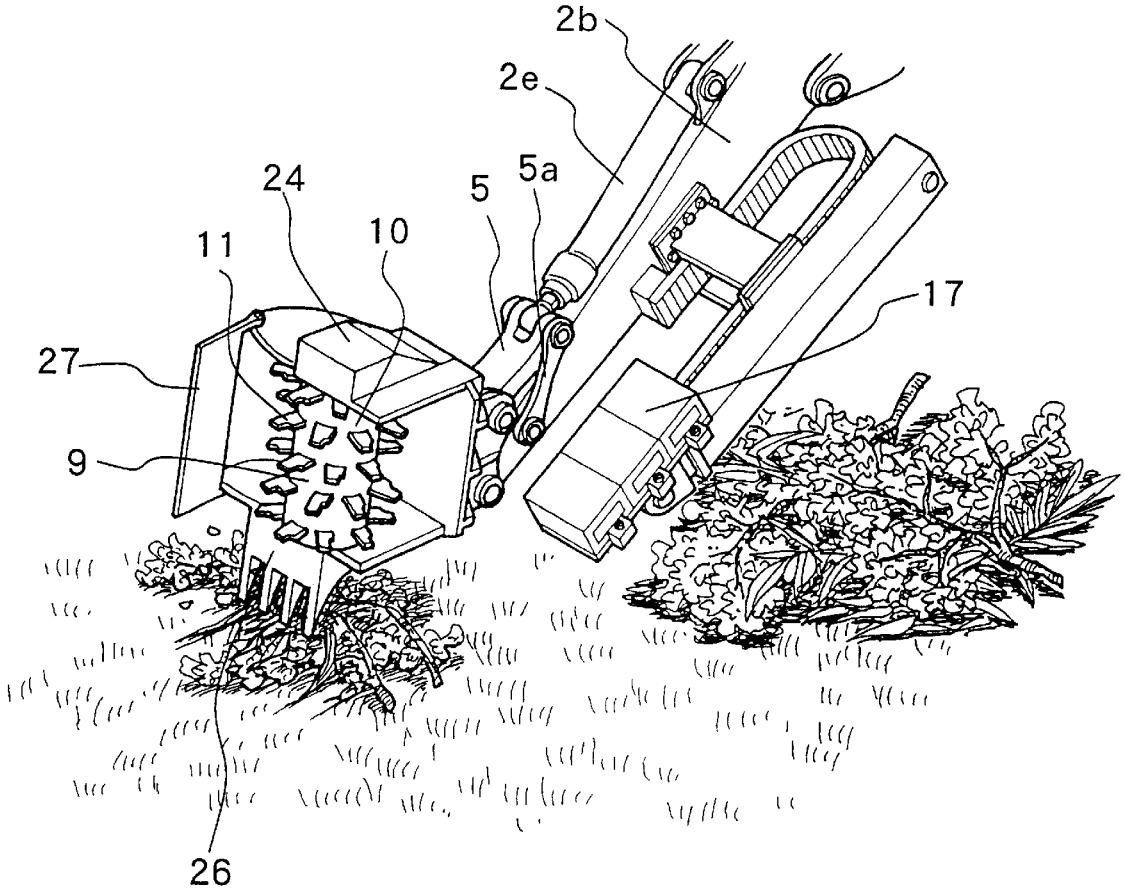
FIG. 7 is a view useful in explaining a rateau work in the mine disposal apparatus and method according to the present invention.

The second step is to cut the vegetation at a height of 10 cm or less so as to easily carry out further detecting works. When the vegetation cut as shown in FIG. 7 is piled up at a height of 10 cm or less on the ground or tall shrub is laid flat, the use of the rateau 26 on a side portion of the rotary cutter 9 causes the vegetation and the shrub to be removed. The trees which are 20 cm or more in height have an influence on the detecting work, etc., if the distances therebetween are narrow, but has no problems if the distances are over 10 cm or more. Therefore, the obstructive trees are cut and then removed, with the distance of 10 cm as a guide. Tall trees are cut in two steps, and then the trees laid flat are removed by using the rateau 26.

When the collapse of clayey wall, mound, bank, etc., causes earth to deeply cover the initial ground, thereby hindering the detecting work and the disposing work, the use of the skeleton bucket causes the earth to be removed up to the initial ground, followed by carrying out further works.

The above-mentioned work is carried out safely so as not to explode the mines, etc., in the earth during which the mines, etc., are under pressure. Further, when carrying out various works related to a rotary cutter system according to the present invention, one person is positioned on a side of the machine main body, who confirms and instructs the working procedures in association with the driver.

Figure 8:
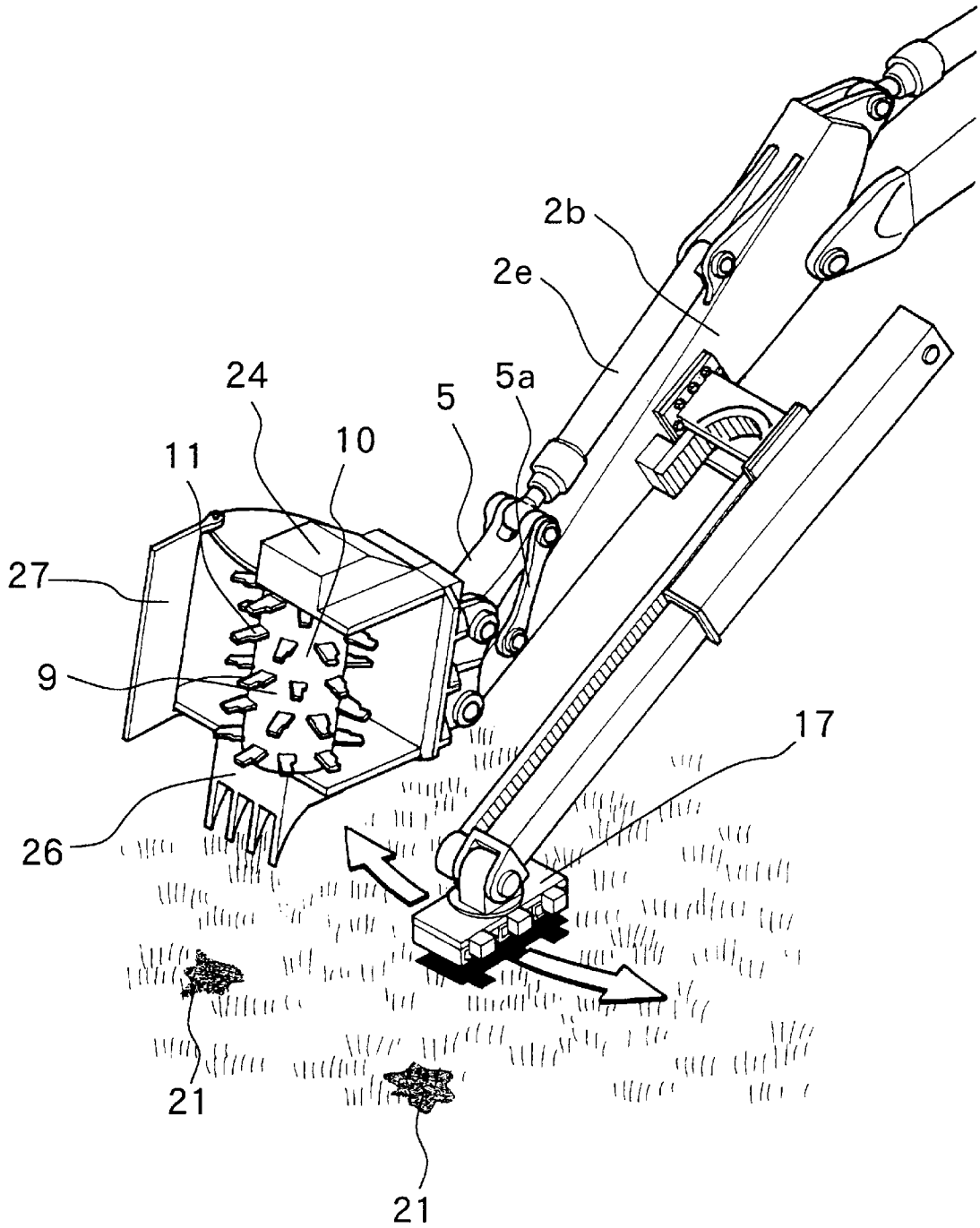
FIG. 8 is a view useful in explaining a mine counting work in the mine disposal apparatus and method according to the present invention.

FIG. 8 shows the detecting work. The sensor portion 17 set at a side portion of the arm 2 carries out the detecting work in two steps. The first step is to carry out the work at a detecting mode. The detecting work is carried out while turning the arm at a turning speed of 2 to 4 km/h with the sensor portion maintained at a constant height of 5 to 10 cm above the ground.

When the buried thing is detected, a discovery signal of voice is transmitted. Changing-over is made to the second step of a precise mode, to thereby detect a correct information. Repeatedly scanning of the sensor portion 17 around the discovery location makes clear the kind of the buried thing, the correct depth, the location, and the kind of the material, followed by displaying the data on the CRT and recording them.

When the location is decided, the sensor portion 17 is held above the mine, etc., followed by injecting an indicating paint 21 on the ground by a marking system shown in FIG. 23. The injecting nozzle 18 injects the indicating paint 21 while the colored water from the colored water storage tank 19 is changed-over by the changing-over electromagnetic valve 23.

Figure 9:
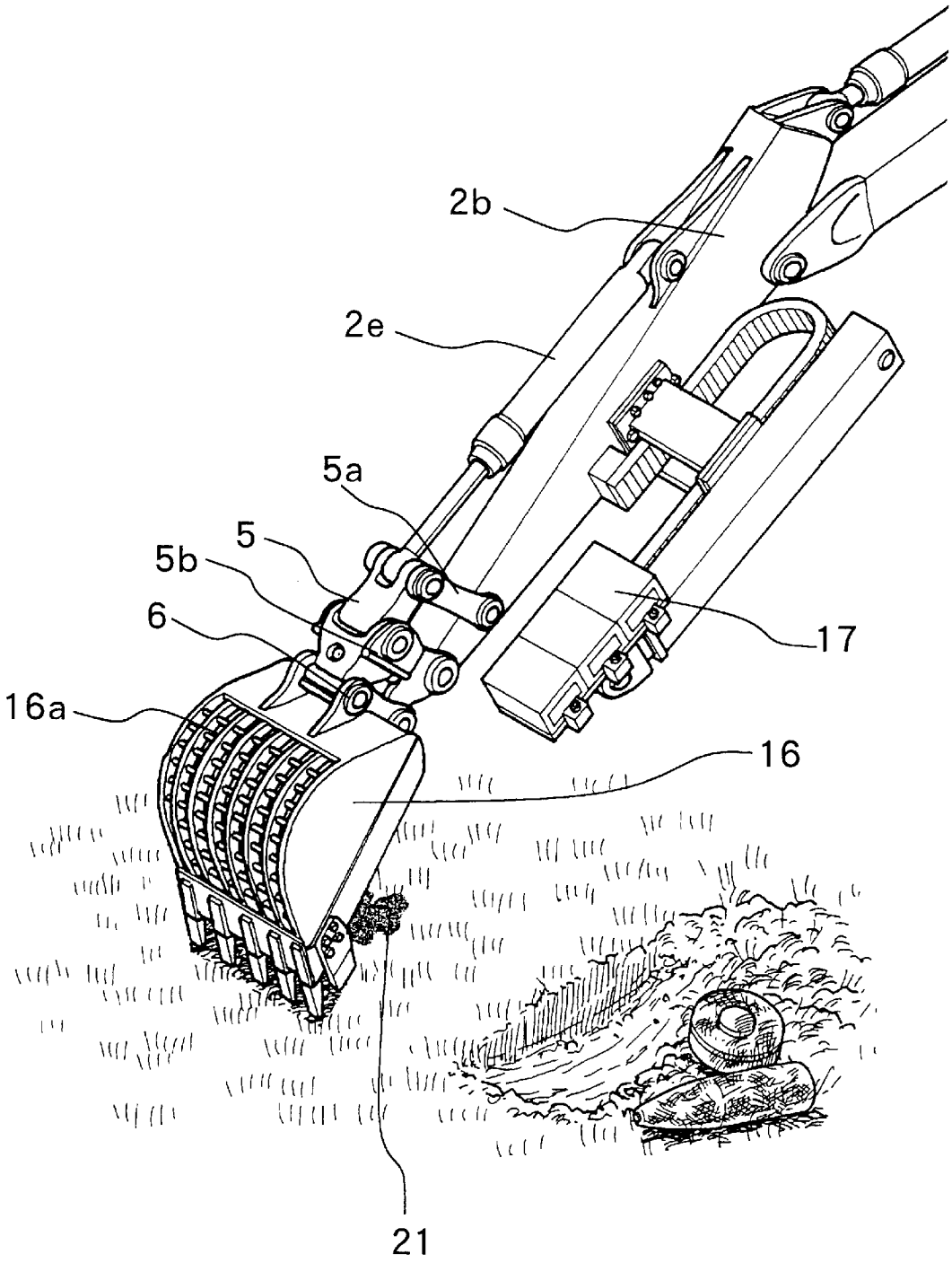
FIG. 9 is a view useful in explaining disposing tank mines and unexploded shells in the mine disposal apparatus and method according to the present invention.

The tank mine or the unexploded shell detected by the detecting work is disposed in order to ensure the safety of further personnel mine disposal by the rotary cutter. As shown in FIG. 9, by the use of the skeleton bucket 16, the tank mine or the unexploded shell embedded in the earth at an indicated location is carefully excavated so as not to explode it, and then the earth in the skeleton bucket 16 is scattered in the rear of the machine main body, followed by separating and exposing the tank mine or the unexploded shell. Thereafter, it is transported and then disposed by manual works, etc.

Figure 10:
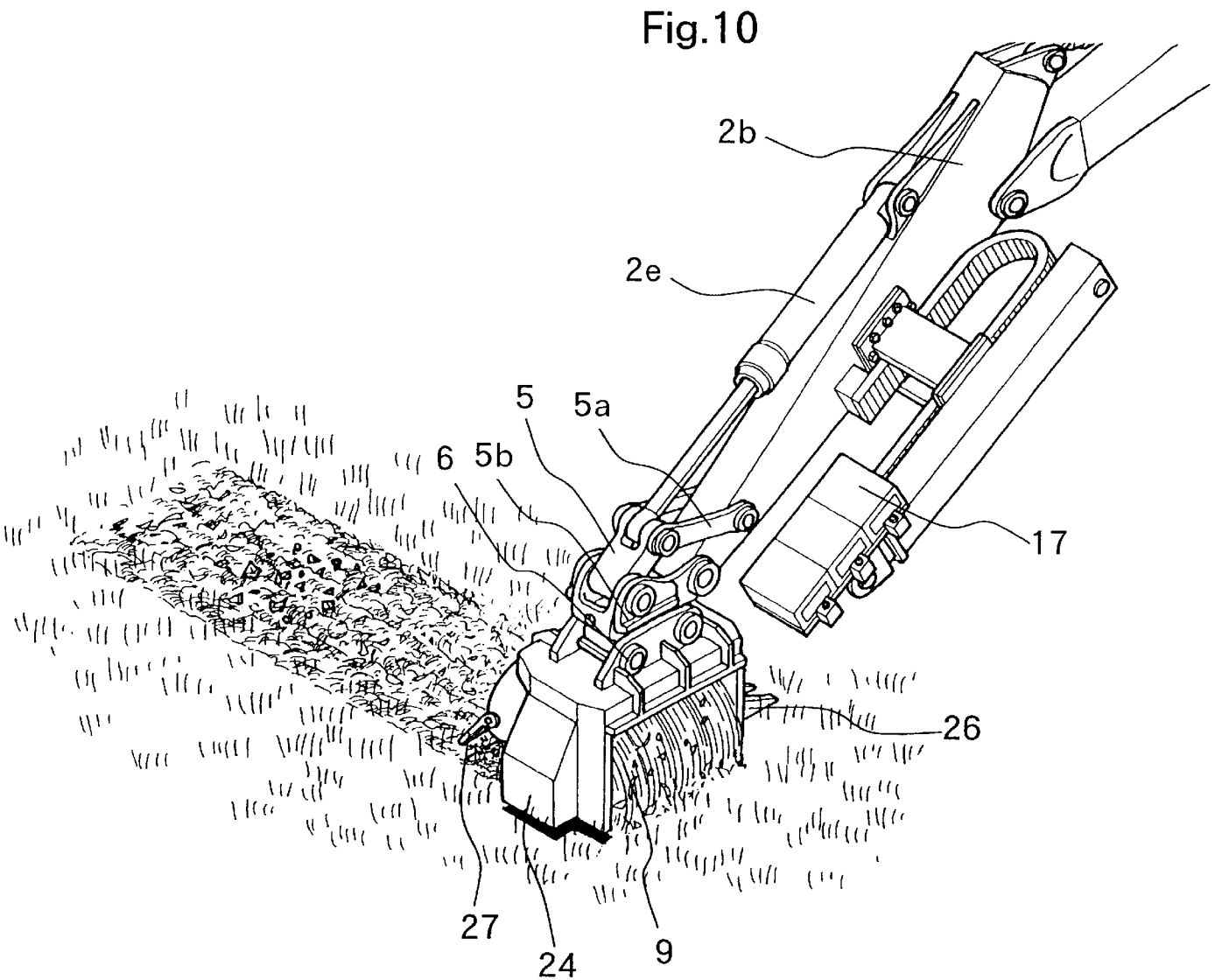
FIG. 10 is a view useful in explaining disposing personnel mines in the mine disposal apparatus and method according to the present invention.

The personnel mines are disposed by clearing all the region everywhere by the rotary cutter 9. As shown in FIG. 10, the disposal work is carried out by turning the rotary cutter 9 while bringing contact to the ground at a guide bottom of the rotary cutter 9 such that blade tips of the rotary cutter 9 reach up to a depth of 30 cm under the ground. The turning speed is changed according to the hardness of the earth and the irregularity of the ground, or a sufficient depth is ensured by the two step-work.

Overlapping by 5 to 10 cm eliminates the undisposed area similarly to the detecting work. The personnel mines are broken without explosion and then the fragments are discharged due to the rotary cutter 9 rotating at a high speed. The fuse may be exploded irrespective of the kind of the mine,-which, however, has not an influence on the apparatus.

According to the above-mentioned work, the personnel mines can be disposed up to a depth of 30 cm, the tank main and the unexploded shell up to a depth of 1 m. Further, checking for extra safety is made whether or not the mines, etc., are remained all over the disposed area by the sensor portion 17. Therefore, it is confirmed that disposal is surely made for the area.

Figure 11:
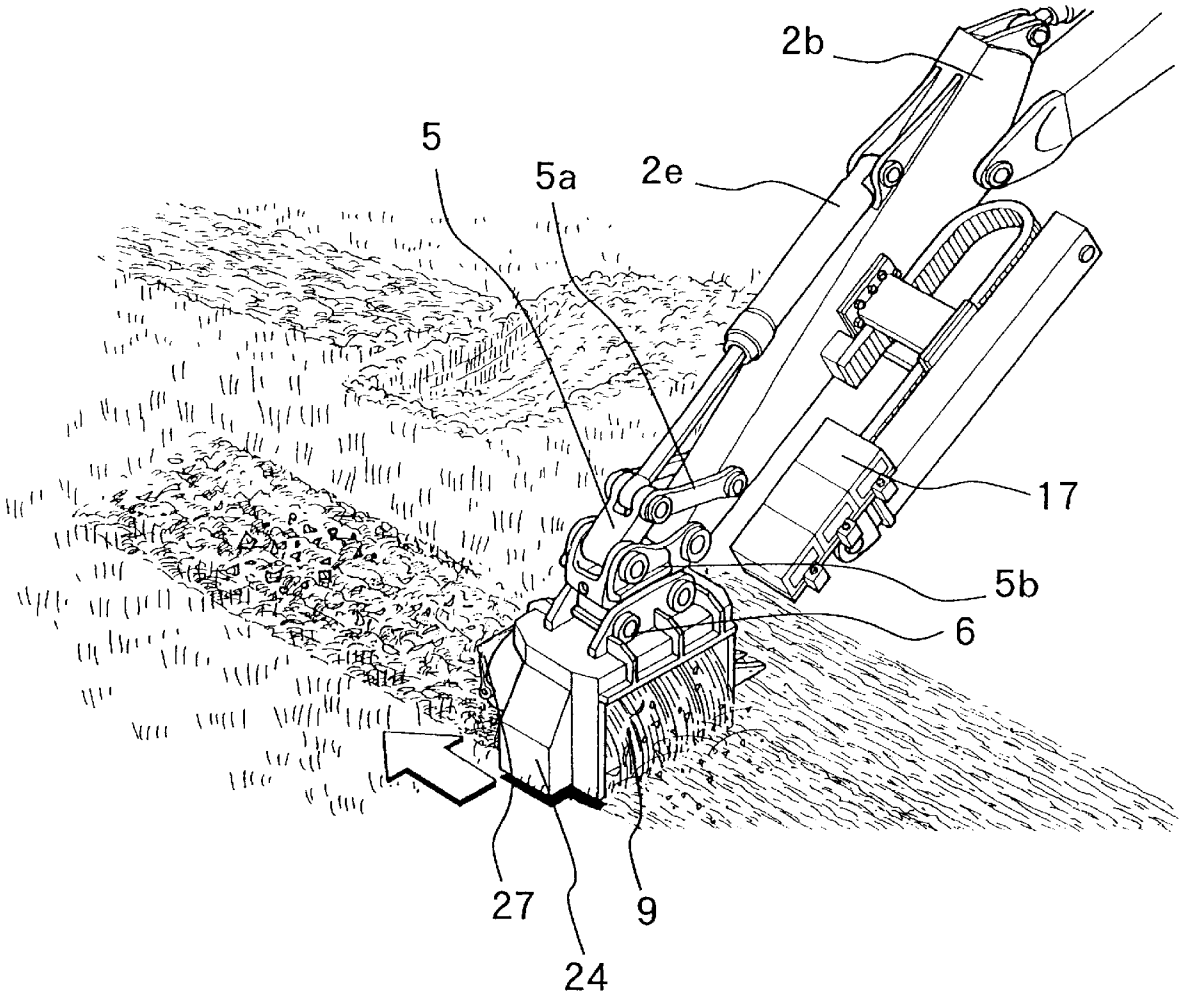
FIG. 11 is a view useful in explaining a farmland improving work after mine disposal in the mine disposal apparatus and method according to the present invention.
Figure 14:
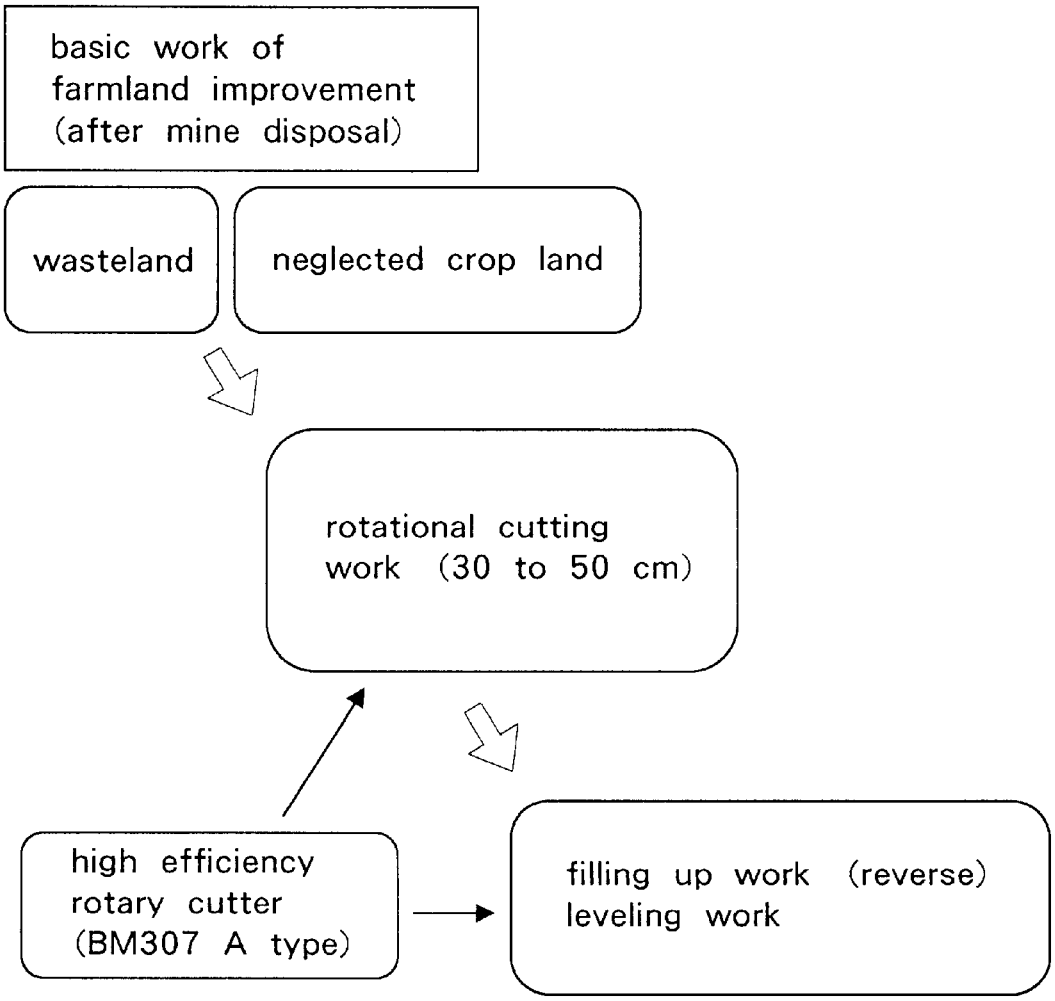
FIG. 14 is a block diagram generally showing farmland improvement in the mine disposal apparatus and method according to the present invention.

A farmland improvement after mine disposal is the same as the improving work of the wastelands and the neglected crop lands, as shown in FIG. 14. As to the reclaimer work using the rotary cutter shown in FIG. 11, replacement the flat H-shaped tip or the flat I-shaped tip shown in FIGS. 21 and 22 from the cemented carbide tip 11*b* of the cutter bits 11 of the rotary cutter 9 enables a wide farmland to be fast disposed.

FIGS. 40 to 43 show another embodiment of a mine detection apparatus portion of a mine disposal apparatus according to the present invention. A portion of the rotary cutter 9 is adaped to be replaced with a sensor portion 17 of the mine counter. The sensor portion 17 is surrounded at a lower face thereof by an open hood 51, and is provided with a cylinder 52 for use in swinging movement.

Figure 44:
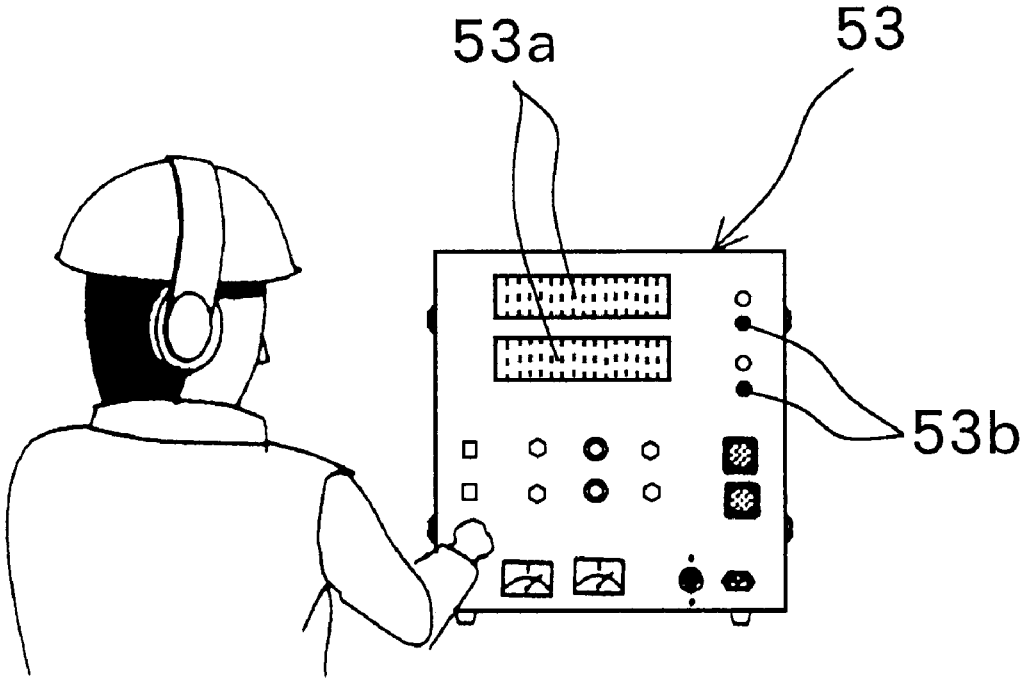
FIG. 44 is a front view of an operation section of another embodiment of the mine detection apparatus portion of the mine disposal apparatus according to the present invention.

A sensor of the sensor portion 17 is comprised of a flux gate type magnetic sensor and a search coil type magnetic sensor, and an operation section 53 comprised of a display panel 53*a* and a speaker 53*b* is, as shown in FIG. 44, disposed at the driver's seat 3 of the heavy vehicle 1. The sound and graph changing on the operation section causes the existence of the mine to be informed to the operator.

Such a magnetic sensor is suited to the detection of metal, but not suited to the detection of a mine having a relatively large synthetic resin made portion. Therefore, another type sensor, e.g. a sensor using a supersonic or laser detecting signal can be used in place of the above-mentioned sensor, or can be used jointly with the above-mentioned sensor.

Figure 45:
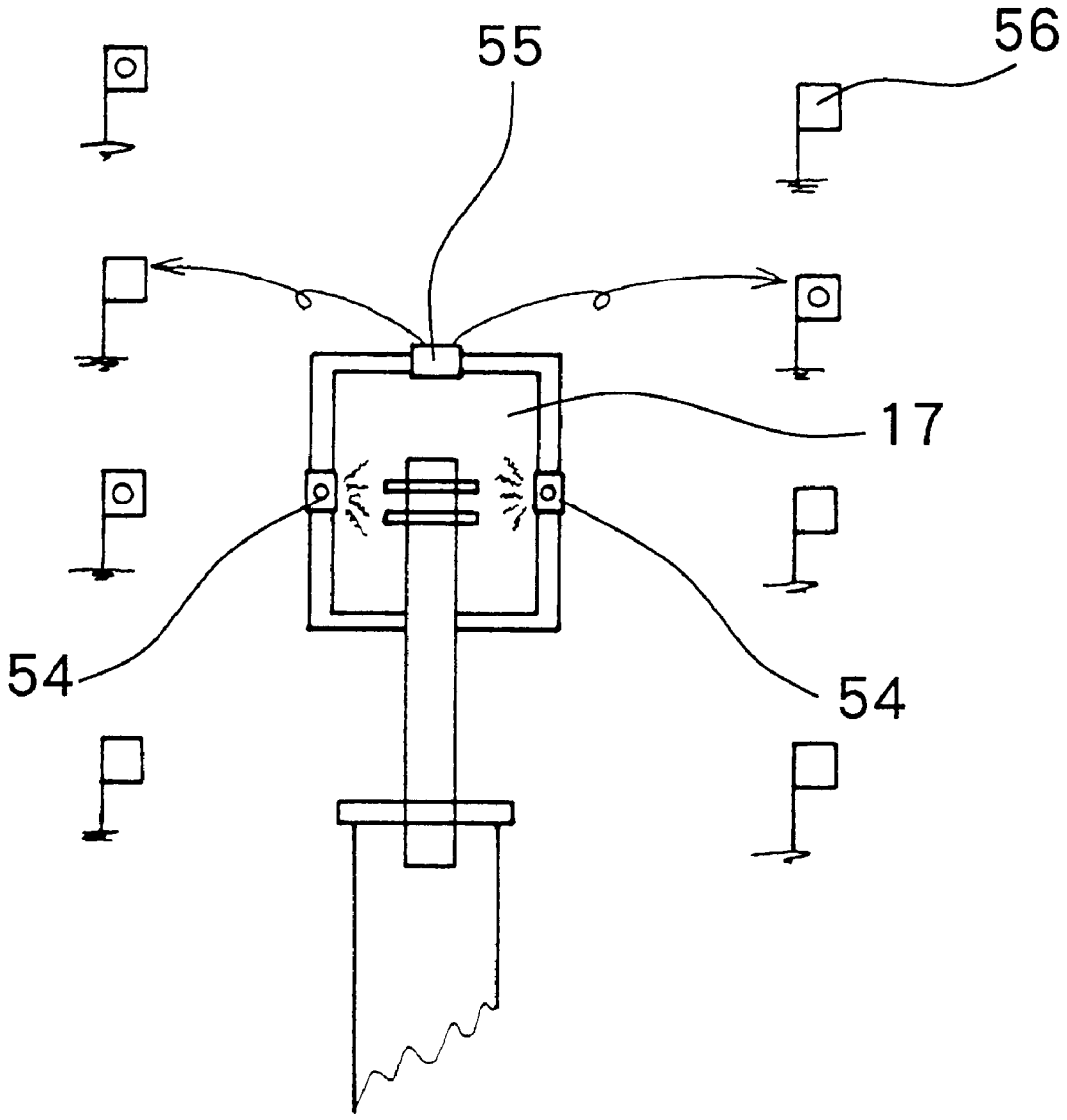
FIG. 45 is a view useful in explaining the operation of another embodiment of the mine detection apparatus portion of the mine disposal apparatus according to the present invention.
Figure 46:
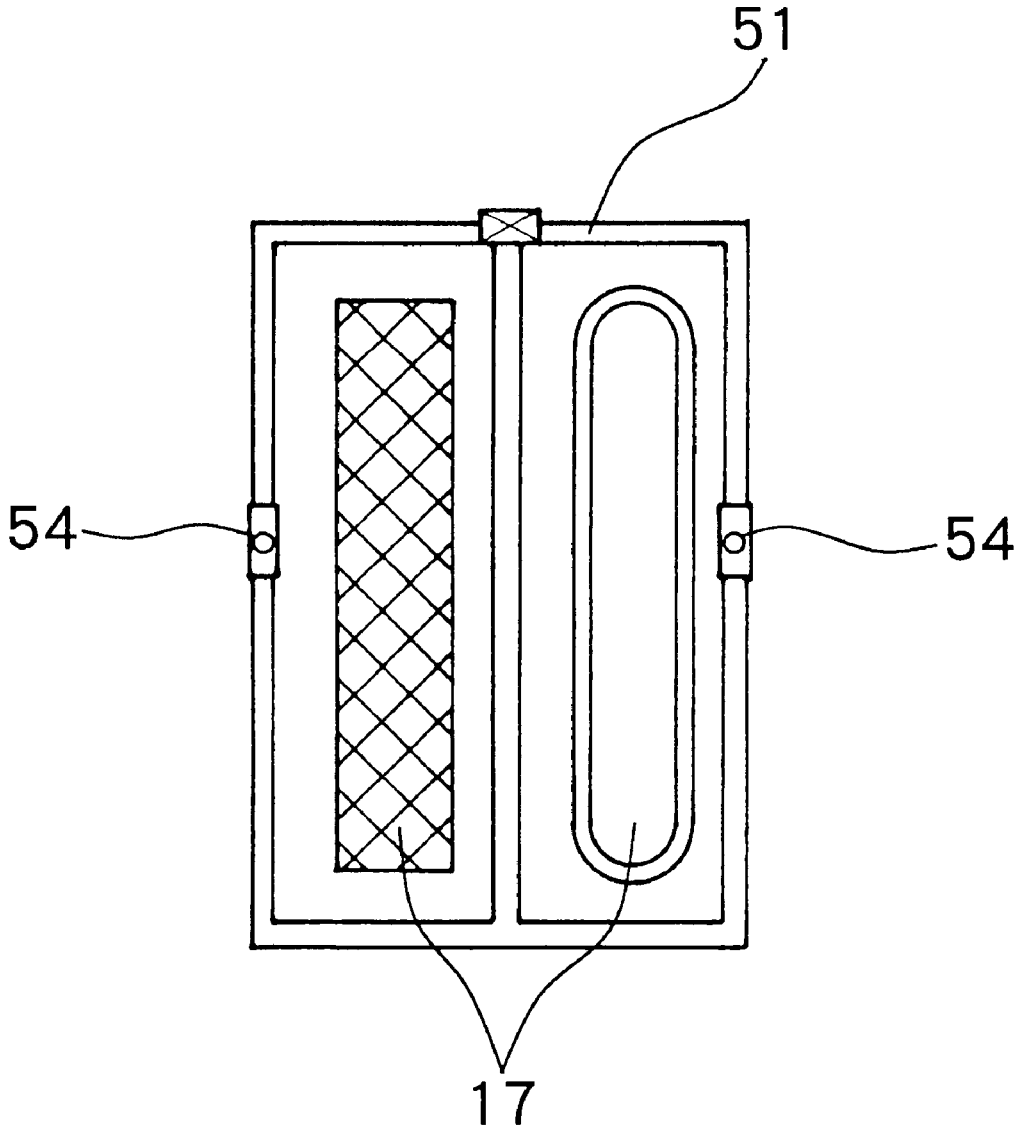
FIG. 46 is a bottom view of a sensor portion of another embodiment of the mine detection apparatus portion of the mine disposal apparatus according to the present invention.

As application examples, a spray nozzle 54 for spraying white powder is, as shown in FIGS. 45 and 46, provided in the vicinity of the sensor portion 17, e.g. on a lower face of the hood 51 at left and right side, portions thereof and also a flag fixing device 55 is provided for fixing flags 56 at the left and right side.

Figure 47:
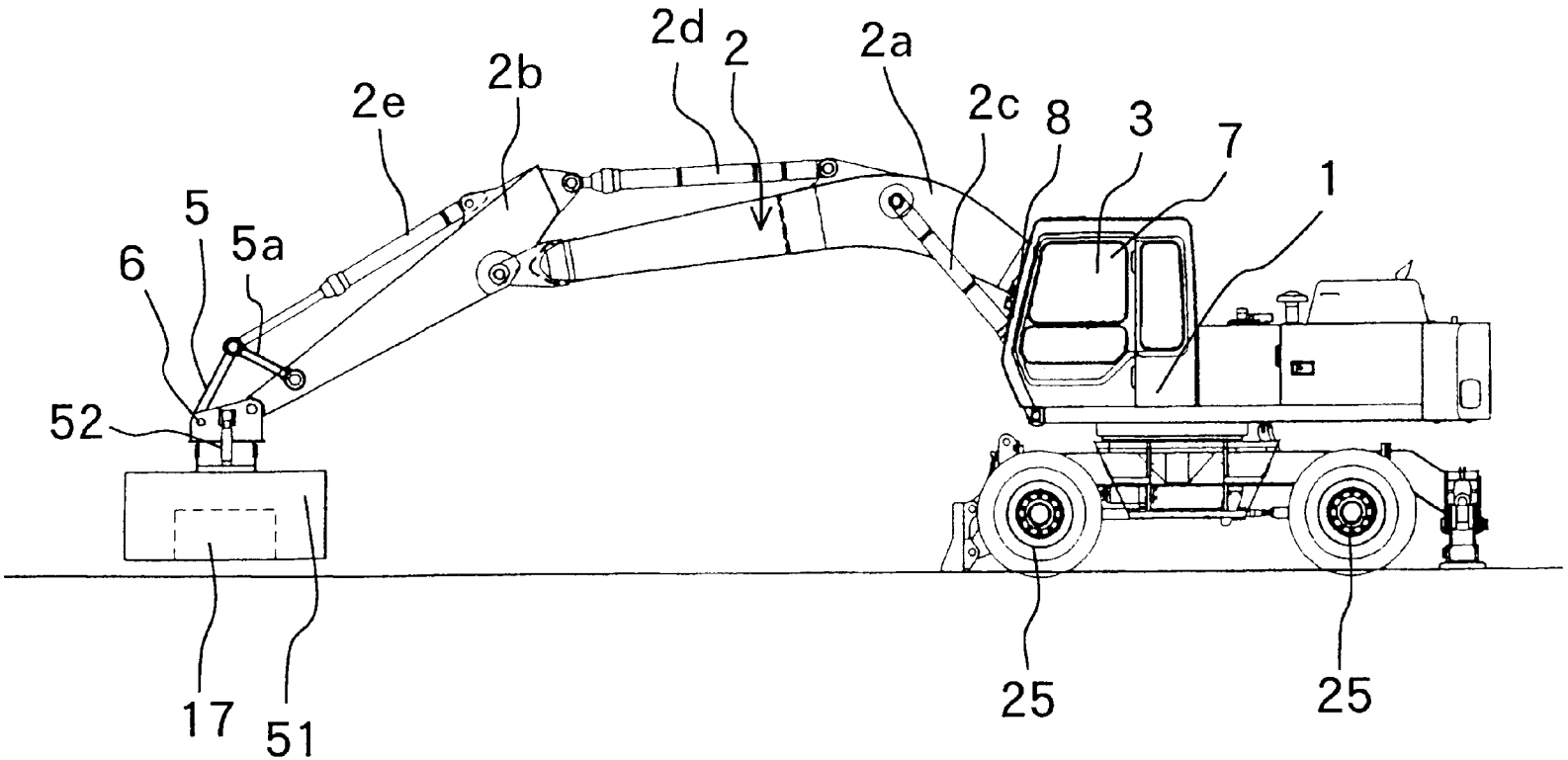
FIG. 47 is a whole side view of another embodiment of the mine detection apparatus portion of the mine disposal apparatus according to the present invention, in which a heavy vehicle is replaced with another example.

Further, the heavy vehicle 1 may be of a wheel type travelling gear having wheels 25 in place of caterpillars as shown in FIG. 47.

The using manner is the same as the mine disposal apparatus according to the present invention. The heavy vehicle 1 advances, retreats and turns by the use of the caterpillars 4 or the wheels 25. An operator sits on the driver's seat 3 to drive the heavy vehicle 1 to cause the sensor portion 17 to get close to and then detect the mine by the use of the derrickable and foldable arm 2.

In detail, the derrickable and foldable arm 2 is horizontally swung over within a 10-m-range of a detection region with the sensor portion 17 held at about 100-mm-height above the ground surface. Whenever once detecting the ground, the heavy vehicle 1 extends the derrickable and foldable arm 2 by 1 m, or advances without extending the derrickable and foldable arm 2. The heavy vehicle 1 detects the left and right sides until the arm is perfectly extended to its full length.

As shown in FIG. 46, the flag fixing device 55, if provided, fixes the flags on the left and right sides in two columns at regular intervals, and then the spraying nozzle 54, if provided, sprays the white powder at a place where the-sensor portion 17 detects the mine. The detected mine is removed by the mine disposal apparatus according to the present invention; thereafter the heavy vehicle 1 is moved to the detection region again to repeat the mine detection.

Industrial Application

As described above, the mine disposal apparatus and the mine disposal method according to the present invention are capable of systematically carrying out works including preparation works such as a vegetation work, and a collapsed sediment removing work, etc., and safely and surely disposing personnel mines separately from tank mines, unexploded shells, etc., and further effectively improving the disposed lands to farmlands.

In particular, they can realize a front (advancing) and turning compound movement by an arm movement without a manual operation, and carry out works while turning the arm to safely realize the mine disposal and the mine detection over a wide range, and also carry out works over a wide range with the arm extended to a steep slope or a narrow place where the machines cannot enter.

As to the mine disposal, they can surely dig personnel mines embedded in the sediment and then cut and crush the mines, and further realize various works of, e.g. cutting and crushing grass, bush, mines, shrub, stumps, and tall trees, and realize a large amount of the works. Also, they can be, after the mine disposal, used for works of, e.g. effectively selecting the remains such as the mines and the shrub, or leveling of the ground, and ditching.

what is claimed is:

1. A mine disposal apparatus comprising a heavy vehicle (1), a derrickable and foldable arm (2) provided on said heavy vehicle (1), a detaching-attaching device (5) disposed on a distal end of said derrickable and foldable arm (2) of said heavy vehicle (1), and a rotary cutter (9) replaceably attached to said distal end of said foldable arm (2) by said detaching-attaching device, said rotary cutter (9) having a rotational drum (10), cutter holders welded on a circumferential face of said rotational drum (10), and cutter bits (11) displaceably detachably attached to said cutter holders (13), said rotary cutter (9) having hydraulic driving motors (12) on left ad right portions thereof for directly driving said rotary cutter, said rotary cutter (9) being capable of cutting earth up to a depth of 30 cm or more, said detaching-attaching device (5) having a built-in sliding mechanism, at a distal end of a link mechanism for varying a distance between members for holding pins (6) of said detaching-attaching device disposed on a distal end of said arm.

2. A mine disposal apparatus as claimed in claim 1, wherein said rotary cutter (9) has a left and right directionwise rotational mechanism (50) below a portion thereof coupled to said attachment detachably-attaching device (5).

3. A mine disposal apparatus as claimed in claim 1 or 2, wherein a window glass of a driver's seat (3) of said heavy vehicle (1) is comprised of a bullet-proof glass (7), and a guard (8) of a metal-made net body is disposed on a front side of said window.

4. A mine disposal apparatus as claimed in claim 3, wherein said rotary cutter (9) is replaceable with a skeleton bucket (16) by the use of said attachment detachably-attaching device (5).

5. A mine disposal apparatus as claimed in claim 2, wherein a sensor portion (17) of a mine counter is attached to said attachment detachably-attaching device (5).

6. A mine disposal apparatus as claimed in claim 5, wherein a sensor portion (17) of a mine counter is attached to a side portion of said derrickable and foldable arm (2) of said heavy vehicle (1) used for shovel type machines such as back hoes.

7. A mine disposal apparatus as claimed in claim 6, wherein said rotary cutter (9) is provided with a rateau (26).

8. A mine disposal apparatus as claimed in claim 7, wherein in said rotary cutter (9), said cutter bits (11) are arranged on said rotational drum (19) spirally in such a manner that the spirally winding direction corresponds to the rotational direction.

9. A mine disposal method comprising the ordered steps of:

replaceably attaching a rotary cutter (9) and a skeleton bucket (16) to a distal end of a derrickable and foldable arm (2) of a heavy vehicle (1), said foldable arm (2) having a sensor portion (17) attached to a side portion of said foldable arm (2), removing vegetation such as shrub, ditch reed, and grass by said rotary cutter (9), or removing collapsed sediment by said skeleton bucket (16);

distinguishing between a personnel mine and a tank mine or an exploded shell by said sensor portion (17);

exposing said tank mine or said exploded shell by said rotary cutter (9) and said skeleton bucket (16);

transporting said tank mine or said exploded shell to an explosion location; and breaking said personnel mine by said rotary cutter (9) rotating at a high speed.

10. A mine disposal method as claimed in claim 9, wherein cutter bits (11) of said rotary cutter (9) are replaceable.

* * * * *